US006819046B2

(12) United States Patent
Hirano

(10) Patent No.: US 6,819,046 B2
(45) Date of Patent: Nov. 16, 2004

(54) PLASMA DISPLAY PANEL HAVING AN IMPROVED PLANE ELECTRODE STRUCTURE

(75) Inventor: Naoto Hirano, Tokyo (JP)

(73) Assignee: Pioneer Corporation (JP)

( * ) Notice: Subject to any disclaimer, the term of this patent is extended or adjusted under 35 U.S.C. 154(b) by 463 days.

(21) Appl. No.: 09/791,530

(22) Filed: Feb. 23, 2001

(65) Prior Publication Data

US 2001/0024921 A1 Sep. 27, 2001

(30) Foreign Application Priority Data

Feb. 24, 2000 (JP) ..... 2000-048380

(51) Int. Cl.[7] ..... H01J 17/49
(52) U.S. Cl. ..... 313/582; 313/585
(58) Field of Search ..... 313/582–587, 313/349, 333, 491, 574, 631, 632

(56) References Cited

U.S. PATENT DOCUMENTS

| | | | | |
|---|---|---|---|---|
| 5,640,068 | A * | 6/1997 | Amemiya | 313/582 |
| 5,742,122 | A * | 4/1998 | Amemiya et al. | 313/582 |
| 5,962,974 | A * | 10/1999 | Komaki et al. | 313/582 |
| 6,008,580 | A * | 12/1999 | Nakamura et al. | 313/568 |
| 6,333,599 | B1 * | 12/2001 | Kawanami et al. | 313/582 |
| 6,348,762 | B1 * | 2/2002 | Nunomura et al. | 313/582 |
| 6,452,333 | B1 * | 9/2002 | Torisaki et al. | 313/586 |
| 6,512,337 | B2 * | 1/2003 | Hirano et al. | 315/169.4 |
| 6,522,072 | B1 * | 2/2003 | Yura et al. | 313/582 |
| 6,534,914 | B2 * | 3/2003 | Amemiya et al. | 313/586 |
| 6,577,061 | B2 | 6/2003 | Sano et al. | 313/582 |
| 6,603,263 | B1 * | 8/2003 | Hashimoto et al. | 313/584 |
| 2001/0050533 | A1 * | 12/2001 | Hirose | 313/583 |
| 2001/0054872 | A1 * | 12/2001 | Okigawa et al. | 313/586 |
| 2002/0024303 | A1 * | 2/2002 | Sano et al. | 313/582 |
| 2002/0063524 | A1 * | 5/2002 | Nakamura et al. | 313/582 |
| 2002/0084752 | A1 * | 7/2002 | Yoshioka et al. | 313/584 |

FOREIGN PATENT DOCUMENTS

| | | | |
|---|---|---|---|
| JP | 8-022772 | 1/1996 | H01J/11/00 |
| JP | 8-250030 | 9/1996 | H01J/11/02 |
| JP | 08-315735 | 11/1996 | H01J/11/02 |
| JP | 11-126561 | 5/1999 | H01J/11/02 |
| JP | 11-149873 | 6/1999 | H01J/11/02 |
| JP | 11-212515 | 8/1999 | G09G/3/28 |
| JP | 11-306996 | 11/1999 | H01J/11/020 |
| JP | 2001-052623 | 2/2001 | H01J/11/02 |
| JP | 2001-160361 | 6/2001 | H01J/11/02 |

* cited by examiner

*Primary Examiner*—Ashok Patel
*Assistant Examiner*—German Colón
(74) *Attorney, Agent, or Firm*—Hayes Soloway P.C.

(57) ABSTRACT

The PDP disclosed herein has a plurality of thin wire electrodes extending in the row direction, which are laid out in such a way as to widen the interval at a fixed ratio (2 times) from the discharge gap section toward the non-discharge gap section as well as to shorten the lengths of those row direction thin wire electrodes in steps with a fixed difference (approximately 20 μm×left/right) from the cell's vertical center axis toward the partition walls. They are connected by thin wire electrodes that extend in the column direction to form antenna-shaped plane electrodes and the thin wire electrodes that extend in the column direction from the center of the antenna-shaped plane electrodes and the bus electrodes that extend in the row direction are connected to form a sustaining electrode pair (scan electrode and common electrode).

40 Claims, 14 Drawing Sheets

PLASMA DISPLAY PANEL HAVING AN IMPROVED PLANE ELECTRODE STRUCTURE

BACKGROUND OF THE INVENTION

1. Technical Field of the Invention

The invention relates to a plasma display panel, more specifically, to a plasma display panel having an improved plane electrode structure.

2. Related Art

The plasma display panel ("PDP") is well known as a thin flat image display device having a large display screen and displaying a mass information. In the plasma display panel, electrons are accelerated by means of an electric field to cause them to collide with a discharged gas to excite it and convert ultraviolet light irradiated through a relaxation process of the exited gas into visible light to display images. Among various types, the alternating current ("AC") PDP is superior than the direct current ("DC") PDP in terms of luminance, luminous efficiency and operating life.

An example of this type of AC type PDP is disclosed in Japanese Unexamined Patent Publication No. 149873 of 1999. FIG. 1 and FIG. 2 are both plan views of a unit cell (single color illuminating cell) portion of said PDP disclosed by said publication and correspond with FIG. 7 and FIG. 8 of said publication respectively. The constitution of the prior art will be describe below using FIG. 1 and FIG. 2.

On a back substrate 51, a plurality of metal data electrodes 52 are formed at a specified interval in the column direction, on top of which a white dielectric material layer 53 is formed. On the white dielectric material layer 53, located between the data electrodes 52, stripe partition walls 54 are formed at a specified interval in the column direction. Containing the side faces of said partition walls and on the white dielectric layer 53, a plurality of fluorescent material layers 55, each of which consists of a set of fluorescent material layers 55*r*, 55*g* and 55*b*, each of which generates visible red (r), green (g) and blue (b) light respectively, are formed repeatedly in the column direction.

On the other hand, beneath a front substrate 56, a plurality of stripe plane electrodes 57*a* are formed in pairs in the row direction at a specified interval forming a pair, below which a plurality of metallic bus electrodes 58 are formed at a specific interval in the row direction. Beneath the stripe plane electrodes 57*a* and the bus electrode 58, a transparent dielectric layer 61 is formed, under which is formed a protection layer 62. The stripe plane electrode 57*a* and the bus electrode 58 form a pair of sustaining electrodes consisting of a scan electrode 59 and a common electrode 60.

Said back substrate 51 and said front substrate 56 are put together sandwiching their constituents inside and are sealed air tight with a sealing part provided on the periphery of the substrate. A discharged gas consisting of gaseous atoms and gaseous molecules for generating ultraviolet light is encapsulated in the inside of the above.

Next, let us describe the operating principle of the prior art. Writing discharge is created by causing an opposing discharge between a data electrode 52, to which signal voltage pulses are applied independently by each line, and a scan electrode 59, to which write voltage pulses are applied due to line sequential scanning, in order to generate wall electric charges and priming particles (electrons and ions) to perform a cell selecting operation. The selected cell generates a sustaining discharge by means of a plane discharge between the scanning electrode 59, to which a sustaining voltage is applied following the writing voltage pulses, and the common electrode 60, in order to cause visible light luminescence of the fluorescent material layers 55 to operate the cell to display.

In the conventional structure shown in FIG. 1 and FIG. 2, since the stripe plane electrode 57*a* is formed in a wide range over a plurality of cells, there was a problem in that the sustaining current (current that runs in accordance with the sustaining discharge), which runs in proportion to the sustaining electrode area, is too large causing large power consumption. When the power consumption is large, it creates not only a large load on the drive circuit, but also an increase in heat generation of the panel, thus resulting in the problem of reliability.

Furthermore, the conventional structure shown in FIG. 1 and FIG. 2 tends to cause a spread of plasma into adjacent cells in vertical and horizontal directions as a result of discharge, thus creating a problem of incorrect light turn on and turn off due to discharge interferences between adjacent cells.

A countermeasure normally taken to cause a selected cell to perform a luminescence display uniformly over the entire panel surface is to generate a strong discharge by increasing the writing voltage (potential difference that can cause writing discharge between a data electrode 52 and a scan electrode 59) and the sustaining voltage (potential difference that can cause sustaining discharge between a scan electrode 59 and a common electrode 60) to high levels, thus generating more wall charges and priming particles so that the capability of transition from writing operations to sustaining operations can be improved. However, if discharge interferences can easily occur between adjacent cells, it is impossible to increase the writing voltage and the sustaining voltage because incorrect light turn on and turn off discharges occur at unselected cells adjacent to the selected cell and cause the unselected cells to turn on and turn off incorrectly when high discharges are caused by increasing the writing voltage and the sustaining voltage to high levels. As a result, the PDP's display image quality seriously deteriorates.

On the other hand, lowering of the writing voltage and the sustaining voltage in order to suppress the discharge interferences between adjacent cells deteriorates the capability making a transition from the writing operation to the sustaining operation and makes it impossible to perform a normal luminescence display, hence also deteriorating the PDP's display image quality. In other words, it was impossible to expand the operating margin and improve the display image quality with the conventional structure shown in FIG. 1 and FIG. 2.

In order to solve the above problem, a PDP with the structure disclosed by the Japanese Unexamined Patent Publication No. 22772 of 1996 was proposed. FIG. 3 and FIG. 4 are both the plan views of a unit cell portion of said PDP disclosed by said publication and correspond with the constitutions shown in FIG. 7(*b*) and FIG. 7(*a*) of said publication respectively.

In the conventional structure shown in FIG. 3, plane electrodes 57*b* are formed by means of rectangular transparent electrodes disposed in each unit cell and these rectangular plane electrodes 57*b* are connected by bus electrodes 58 provided on the side of non-discharging gaps 64 in the row direction to form a pair of sustaining electrodes (scan electrode 59 and common electrode 60). On the other hand, in the conventional structure shown in FIG. 4, plane electrodes 57*c* are formed by means of T-shaped transparent electrodes disposed in each unit cell and these T-shaped plane electrodes 57*c* are connected by bus electrodes 58 provided on the side of non-discharging gaps 64 in the row direction to form a pair of sustaining electrodes (scan electrode 59 and common electrode 60). As to the bus electrodes 58, there is no mention of them in FIG. 7(*b*) and FIG. 7(*a*) of the Japanese Unexamined Patent Publication No. 22772 of 1996, but it was described in the above assuming that the bus electrodes 58 exist as in the structure of the conventional PDP.

In the conventional structures shown in FIG. 3 and FIG. 4, the sustaining current is reduced by reducing the sustaining electrode area compared to that of the conventional structure shown in FIG. 2 by means of providing the plane electrodes 57*b* and 57*c* independently in each unit cell. Furthermore, by optimizing the length of the plane electrodes (forming the discharge gap 63) in the column direction and the length of the plane electrodes in the row direction, the discharge starting voltage is reduced in order to reduce the consumption voltage while maximizing the luminous efficiency. In particular, in the case of the conventional structure shown in FIG. 4, the power consumption can be substantially reduced from the conventional structure shown in FIG. 2, so that the heat generation per unit cell can be reduced as well. These features are described in paragraphs No. [0019], [0025] and [0026] of the Japanese Unexamined Patent Publication No. 22772 of 1996 respectively.

In order to solve the above problem, a PDP with the structure disclosed by the Japanese Unexamined Patent Publication No. 250030 of 1996 was proposed. FIG. 5 and FIG. 6 are both the plan views of a unit cell portion of said PDP disclosed by said publication and correspond to the constitutions shown in FIG. 2 and FIG. 4 of said publication respectively.

In the conventional structure shown in FIG. 5, transparent electrodes (transparent conducting films) 72 of the sustaining electrodes 72A that form a sustaining electrodes pair have protruding parts 72*a* opposing each other in each cell and the bus electrodes (metallic film) 73 are provided to cross over inside parts 72*b* of the transparent electrodes 72, thus partially covering the protruding parts 72*a* of the transparent electrodes 72, and providing a boundary resistance in each cell independently between base areas 72*c* of the protruding parts 72*a* and the bus electrodes 73. On the other hand, the conventional structure shown in FIG. 6 shows a case where the protruding parts 72*a* of the transparent electrodes 72 are made narrower than the widths of heads 72*e* also forming T-shapes. According to the structure shown in FIG. 6, as the areas of the protruding parts 72*a* are smaller than in those of the sustaining electrodes 72A shown in FIG. 5, the discharge current can be further reduced.

The transparent electrodes 72 are made of ITO (indium tin oxide) or $SnO_2$ (tin oxide), and the bus electrodes 73 are made of Al (aluminum) or Al alloy. Data electrodes 79 are provided in such a way as to cross over the sustaining electrodes 72A.

In the conventional structures shown in FIG. 5 and FIG. 6, the bus electrodes 73 are made of low resistance Al or Al alloys in order to alleviate the waveform dulling of voltage pulses that can be caused by voltage drops, so that the drive margin can be improved and luminance variation can be suppressed. Moreover, the peak value of the sustaining current is reduced to enable the consumption current to be reduced by providing a boundary resistance in each cell independently between the base areas 72*c* of the protruding parts 72*a* of the transparent electrodes 72 and the bus electrodes 73. Furthermore, since the partition walls 72*a* of the transparent electrodes 72, which correspond to the plane electrodes 57*a*, do not exist in the areas that correspond to the partition walls 54 shown in FIG. 1 and FIG. 2, it is claimed that error discharges between the horizontally adjacent cells can be reduced. These features are described in the paragraphs No. [0025], [0026] and [0028] of the Japanese Unexamined Patent Publication No. H8(1996)-250030 respectively.

However, the conventional PDPs described in the above publications have the following problems.

First, although the conventional structure shown in FIG. 3 disclosed by the Japanese Unexamined Patent Publication No. 8-22772 of 1996 succeeds in making the plasma generated by the sustaining discharge extend thick and long thus resulting in a high luminance, it has a problem in that its sustaining electrode surface is wider so that its luminous efficiency is lower as the sustaining current is larger than the conventional structure shown in FIG. 4 disclosed by the Japanese Unexamined Patent Publication No. 8-22772 of 1996.

Next, although the conventional structure shown in FIG. 4 provides a higher luminous efficiency as the plasma generated by the sustaining discharge extends thin and long, it has a problem in that it produces less sustaining current compared to the conventional structure shown in FIG. 3, so that its luminance is lower. In other words, neither the conventional structure shown in FIG. 3 nor the one shown in FIG. 4 can have both a high luminance and a high luminous efficiency simultaneously.

The conventional structure shown in FIG. 3 has a further problem that the plasma generated by the sustaining discharge has a stronger tendency to spread in the vertical and horizontal directions than the conventional structure shown in FIG. 4, and tends to cause light to turn on and turn off incorrectly due to discharge interferences between adjacent cells.

Moreover, the conventional structures shown in FIG. 3 and FIG. 4 including the conventional structures shown in FIG. 5 and FIG. 6 disclosed in the Japanese Unexamined Patent Publication No. 8-250030 of 1996 have such reliability problems in that the Al electrodes (e.g., bus electrodes 58) get peeled off partially or totally from the transparent electrodes (e.g., plane electrodes 57*b*, 57*c*) during manufacturing processes, and the Al electrodes separate from the transparent electrodes partially or totally during the panel operation so that poor continuity occurs between them. And disappearance of the Al electrodes and the transparent electrodes themselves due mainly to galvanic cell corrosion between them during the patterning process of the Al electrodes.

It is well known that the presence of the Al electrodes that are generally apt to produce oxides and the transparent electrodes which are essentially oxides, which contact each other, may cause various problems. This is due to the fact that $Al_2O_3$ (aluminum oxide) is thermodynamically less stable than, for example, $In_2O_3$ (indium oxide) or $SnO_2$ (tin oxide). As a result, a reduction reaction of the transparent electrode occurs in accordance with oxidation of the Al electrode on the interface between the Al electrode and the transparent electrode, which leads to an increase of electrical resistance with formation of an insulation film and an increase of the boundary level. This is the reason why a boundary resistance is formed in the technology disclosed by the Japanese Unexamined Patent Publication No. 8-250030 of 1996.

The above-mentioned reactions can be further accelerated when thermal energy is added and develops a blackening phenomenon as a result of the reduction of the transparent electrodes. This is due to the fact that metal elements are precipitated as a result of the reduction of the transparent electrodes, which are essentially oxides, and it reduces the transmittance of the transparent electrodes and consequently their luminance.

Moreover, the boundary condition becomes sparse due to the oxidation/reduction reactions between the Al electrodes and the transparent electrodes, causing the problem of the Al electrodes that are used as the bus electrodes 58 peeling off from the transparent electrodes used as the plane electrodes 57*b* and 57*c*. Since the bus electrodes 58 are provided to reduce the wavy dulling of the voltage pulses and to apply the specified voltage pulses to the plane electrodes 57*b* and 57*c* disposed in each cell, this is a major problem for the panel operation.

Furthermore, in the process of etching and patterning the Al electrodes using a positive type photo resist as a mask, the Al electrodes can get corroded by the organic alkali developing liquid used for developing the positive type photo resist, so that pinholes can be generated on the Al electrodes. When the developing liquid (electrolytic solution) reaches the transparent electrodes through these pinholes, an electric circuit will be established between the Al electrodes and the transparent electrodes via the developing liquid, and dissolution (oxidation) of the Al electrodes and disappearance (reduction) of the transparent electrodes occur caused by the oxidation/reduction potential difference as the driving force. This phenomenon is known as a galvanic cell corrosion reaction, and it eventually causes both the Al electrodes and the transparent electrodes disappear or severely deteriorate their performances as the electrodes.

This is caused by the fact that the oxidation/reduction potential of the Al electrode is on the base metal side compared to the transparent electrode (the oxidation/reduction potential of the transparent electrode is on the noble metal side compared to the Al electrode), hence causing the electrons generated during the oxidation of the Al electrodes to flow into the transparent electrodes, and the incoming electrons reduce the transparent electrodes. Also, the oxidation/reduction reaction caused by this potential difference as a driving force is more serious than the one caused by the heat as the driving force. It comes from the fact that the corrosion reaction is an electrochemical reaction.

SUMMARY OF THE INVENTION

The object of the invention is to provide an AC plane discharge type plasma display panel with a broader operating margin and a lower power consumption rate by means of achieving a higher luminance and a higher luminous efficiency simultaneously and suppressing the incorrect light turn on and turn off due to discharge interferences between adjacent cells.

An AC plane discharge type plasma display panel according to claim 1, comprises: a front substrate provided with at least a plurality of double sided electrodes that extend in the row direction; and a back substrate provided with at least a plurality of data electrodes that extend in the column direction. Said substrates are arranged to face to each other forming a discharge space theirbetween into which a gas for generating ultraviolet light is introduced and sandwiching partition walls that separate unit illuminating pixels each of which has a fluorescent material layer that emits a visible light of a desired color Said double sided electrodes consist of bus electrodes that extend in said row direction and plane electrodes electrically connected with said bus electrodes. Said plane electrodes consist of discharge sections that are divided spatially into a plurality of regions.

An AC plane discharge type plasma display panel according to claim 2 comprises: a front substrate provided with a plurality of pairs of a scan electrode and a common electrode that extend in the row direction: and a back substrate provided with a plurality of data electrodes that extend in the column direction. Said substrates are arranged to face to each other forming a discharge space theirbetween into which a gas for generating ultraviolet light is introduced and sandwiching partition walls that separate unit illuminating pixels each of which has a fluorescent material layer that emits visible light of a desired color. Said scan electrodes and said common electrodes consist of bus electrodes that extend in said row direction and plane electrodes electrically connected with said bus electrodes. Said plane electrodes consist of discharge sections that are divided spatially into a plurality of regions.

Said fluorescent material layers may consist of a plurality of kinds that emit visible lights of red, green and blue.

Plane electrodes of discharge cells having at least one kind of said a plurality of fluorescent material layers may have a different shape from plane electrodes of discharge cells that have other fluorescent material layers.

Said plane electrodes may be provided for each of said unit illuminating pixels independently.

The density of said divided discharge sections that constitute said plane electrode may stay constant from the row direction center axis of said unit illuminating pixels toward outside.

The density of said divided discharge sections that constitute said plane electrode may increase from the row direction center axis of said unit illuminating pixels toward outside.

The density of said divided discharge sections that constitute said plane electrode may decrease from the row direction center axis of said unit illuminating pixels toward outside.

The density of said divided discharge sections that constitute said plane electrode may stay constant from the column direction center axis of said unit illuminating pixels toward outside.

The density of said divided discharge sections that constitute said plane electrode may increase from the column direction center axis of said unit illuminating pixels toward outside.

The density of said divided discharge sections that constitute said plane electrode may decrease from the column direction center axis of said unit illuminating pixels toward outside.

The density of said divided discharge sections that constitute said plane electrode may stay constant from the row direction center axis of said unit illuminating pixels toward outside and from the column direction center axis of said unit illuminating pixels toward outside.

The density of said divided discharge sections that constitute said plane electrode may increase from the row direction center axis of said unit illuminating pixels toward outside and from the column direction center axis of said unit illuminating pixels toward outside.

The density of said divided discharge sections that constitute said plane electrode may decrease from the row direction center axis of said unit illuminating pixels toward outside and from the column direction center axis of said unit illuminating pixels toward outside.

The plane electrodes may consist of a plurality of thin wire electrodes extending in the row direction, which are disposed in such a way that their intervals expand at a specific rate from a discharge gap section to a non-discharge gap section, while the lengths of said thin electrodes shorten with a specific difference from said discharge gap section to said non-discharge gap section.

Said plurality of thin wire electrodes extending in said row direction may be connected to said bus electrodes via thin wire electrodes extending in the column direction.

Said bus electrodes that extend in said row direction may be disposed between vertically adjacent discharge cells and said plane electrodes extend from said bus electrodes to the vertically discharge cells.

Said bus electrodes may be made of a metal or alloy and said plane electrodes may be made of a transparent electric conductive material.

Said bus electrodes may be made of a metal or alloy and said plane electrodes may be made of a metal or alloy which is the same material to or the different material from the bus electrodes.

The thickness of said plane electrodes may be between 5 nm and 50 nm.

Each of said double sided electrode, said scan electrode, said common electrode and said data electrode has a single layer structure or a multi-layer structure at least partially consisting of one or more of the following substances: Au or Au alloy, Ag or Ag alloy, Cu or Cu alloy, Al or Al alloy, Cr or Cr alloy, Ni or Ni alloy, Ti or Ti alloy, Ta or Ta alloy, Hf or Hf alloy, Mo or Mo alloy, or W or W alloy.

According to the plasma display panel of this invention, the plane electrodes, where lines of electric force are generated, are formed by micro discharge sections spatially divided into several regions, so that plasma can be expanded into the entire cell with a necessary and sufficient electrode surface, so that it is possible to reduce the power consumption substantially, making it possible to substantially improve luminance and luminous efficiency of the conventional PDP.

Furthermore, according to the plasma display panel of this invention, the density of the lines of electric force is designed to reduce from the discharge gap section to the non-discharge gap section as well as from the cell's vertical center axis to the partition wall part, not only the performance of transition from the writing operation to the sustaining operation can be improved, but also the discharge interferences between the vertically and horizontally adjacent cells can be more effectively suppressed, so that the operation margin can be widened. As a result, a better image quality can be achieved.

Furthermore, according to the plasma display panel of this invention, the density of the lines of electric force is designed to increase from the discharge gap section to the non-discharge gap section as well as from the cell's vertical center axis to the partition wall part, the plasma generated by the sustaining discharge in the discharge gap section can be extended more easily into the entire cell, so that the entire fluorescent layer can be irradiated with the ultraviolet light more uniformly, thus improving luminance and luminous efficiency.

Furthermore, according to the plasma display panel of this invention, the density of the lines of electric force is designed to decrease in a fan shape from the discharge gap section to the non-discharge gap section, it is possible to satisfy both the illuminating characteristics (luminance and luminous efficiency) and the voltage characteristics (transition from the writing operation to the sustaining operation and discharging interferences between adjacent cells). As a result, it is possible to reduce the power consumption more than in any other PDPs known so far, and widen the operating margin.

THE DETAILED DESCRIPTION OF THE PREFERRED EMBODIMENTS

Plasma display panels according to the preferred embodiments of the present invention will be described below in detail referring to the accompanying drawings.

First, let us describe the analysis, which became the impetus of this invention.

The following formula shows the relation between the electric power applied to plasma and the power consumed.

$$Pt=Pb+Pr+Pw$$

In the above formula, Pt is the total power applied to plasma, Pb is the power consumed in the bulk to sustain plasma, Pr is the power consumed in the radiation, and Pw is the power consumed in charge recombination and others on the sidewalls that form the discharge space.

Figure 3:
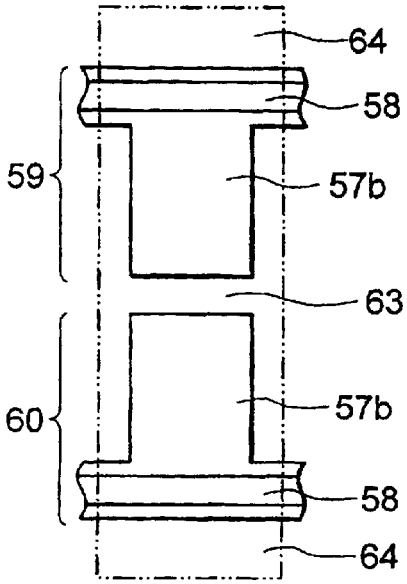
FIG. 3 (PRIOR ART)
FIG. 3 is a plan view showing a unit cell portion of a conventional PDP.
Figure 4:
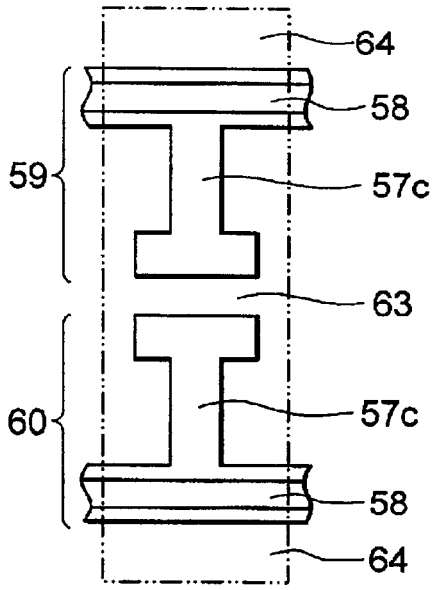
FIG. 4 (PRIOR ART)
FIG. 4 is a plan view showing a unit cell portion of a conventional PDP.
Figure 5:
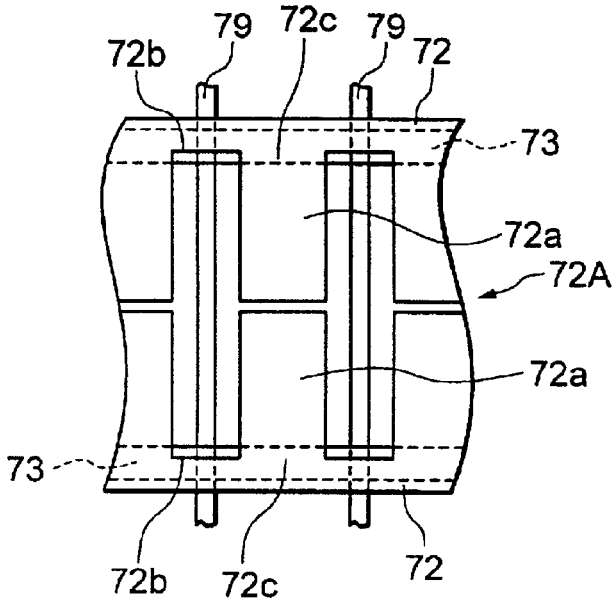
FIG. 5 (PRIOR ART)
FIG. 5 is a plan view showing a unit cell portion of a conventional PDP.
Figure 6:
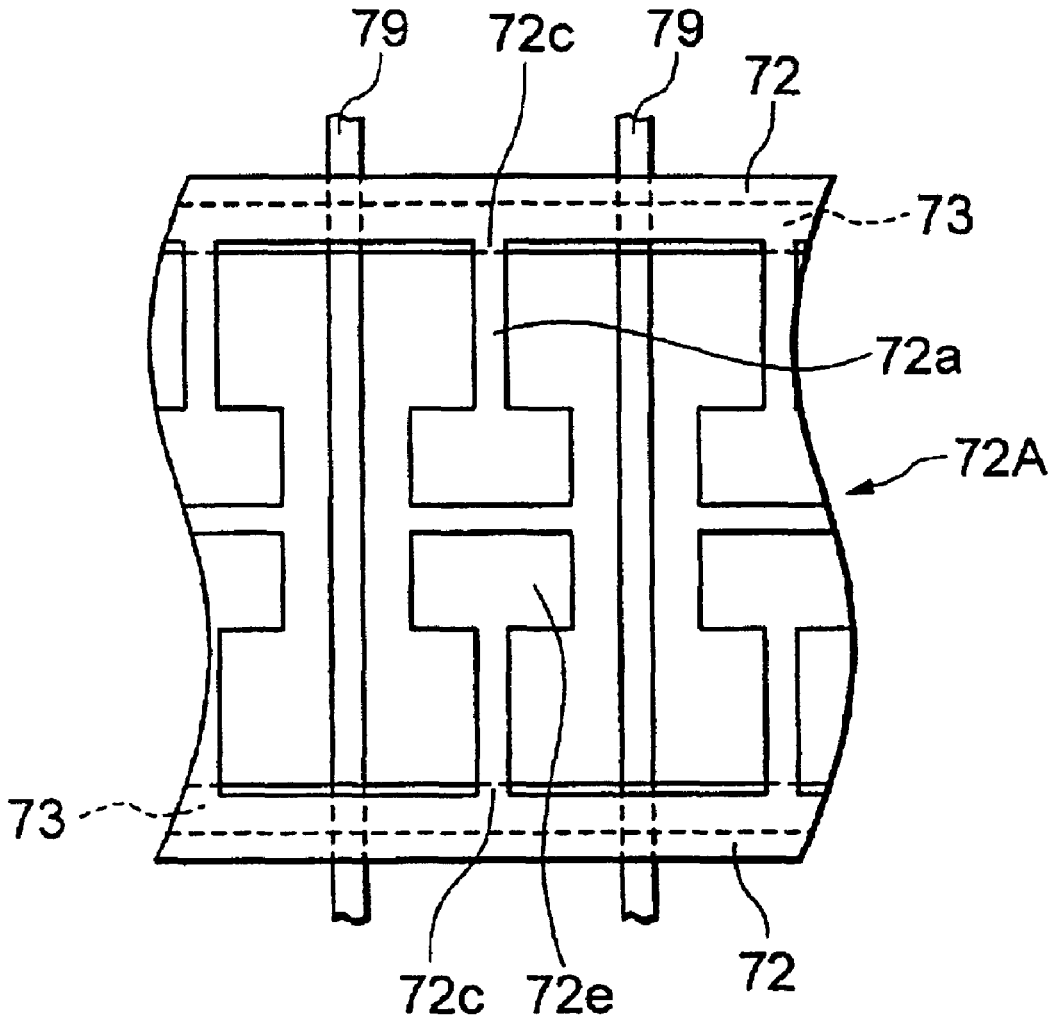
FIG. 6 (PRIOR ART)
FIG. 6 is a plan view showing a unit cell portion of a conventional PDP.

In order to improve luminance and luminous efficiency, the ratio of the ultraviolet light radiation power Pr against the total power consumption Pt should be increased, which, according to the above equation, can be interpreted as decreasing the ratios of the electric power Pb, which is consumed in the bulk, and the electric power Pw, which is consumed in the electric charge recombination and others on the sidewalls, to the total power consumption Pt. However, the power loss Pb in the bulk is necessary to sustain plasma, so it is difficult to decrease its ratio of Pb to Pt. On the other hand, the power loss Pw on the sidewalls can be reduced by separating plasma from the partition walls. In other words, the conventional structure with the plane electrode structure separated from the partition walls 54 as shown in FIG. 3 and FIG. 4 is an effective solution. Japanese Unexamined Patent Publication No. 8-22772 of 1996 and Japanese Unexamined Patent Publication No. 8-250030 of 1996 do not describe the above phenomena and solution.

It is not necessary to generate plasma at a high density and uniformly over the entire cell in the PDP. What is important a bout the visible light emission is not that plasma spreads over the entire cell by the sustaining discharge, but rather that the ultraviolet light effectively irradiates the fluorescent layer contributing to the visible light luminescence. Therefore, it is extremely effective to provide micro sustaining discharge regions over the entire cell in terms of space and time in order to improve luminous efficiency. Thus, it is important to create in terms of space and time independent micro sustaining discharge regions over the entire cell. But, it is extremely difficult to control individual sustaining regions entirely independent of each other. Therefore, a plane electrode structure equipped with sustaining discharge sections spatially divided into several regions becomes an effective measure.

However, if the plane electrode structure has a high discharge starting voltage, the power consumption increases and results in a low luminous efficiency, so that it is necessary to have a plane electrode structure that tends to cause discharge as easily as possible. Also, if the number of discharge gap sections that cause high potential differences between the plane electrodes increases, the number of negative glow regions increases as well, which causes big momentary currents (currents that flow at the start of discharge) although luminance rises, thus resulting in a reduction of luminous efficiency. This is caused by the fact that the majority of the potential difference generated at both ends of the gap between the plane electrodes, i.e., both ends of the plasma, applies on the negative glow regions, so that they become the regions where ionization and excitation occur most actively, but also where the power consumption is the greatest. Therefore, in order to achieve both a high luminance and a high luminous efficiency, it is more advantageous to expand regions with small voltage drops and high ultraviolet light radiation efficiencies, such as positive column regions.

Figure 2:
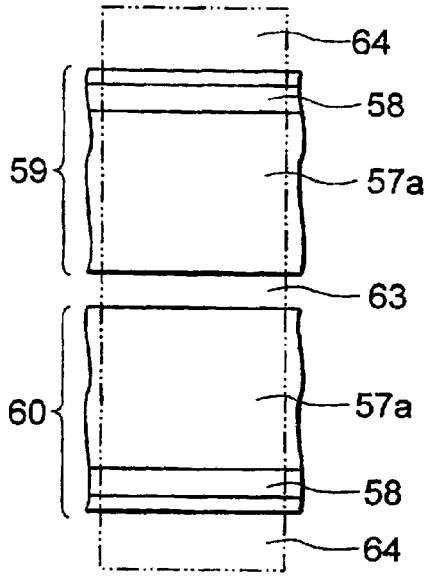
FIG. 2 (PRIOR ART)
FIG. 2 is a plan view showing a unit cell portion of said PDP.

There is a statement in paragraph number [0007] of the Japanese Unexamined Patent Publication No. 11-149873 of 1999 that, in the case of a conventional structure shown in FIG. 2, regions that generate ultraviolet rays are concentrated in the vicinity of the discharge gap 63, thus resulting in a poor luminous efficiency. On the other hand, there is a statement in paragraph [0019] of the same publication that, in case of a conventional structure shown in FIG. 4, slender plane electrodes are formed independently like islands for each unit cell, so that the sustaining discharges do not concentrate in the discharge gap 63 and spread out gradually weakening toward the bus electrodes 58, thus resulting in an improvement of luminous efficiency.

In reality, however, the discharges converge more in the discharge gap 63 and spread out with more difficulty in case of the conventional structure shown in FIG. 4 (where the discharge gap 63 exists isolated in the center of the cell) than in the case of the conventional structure shown in FIG. 2 (where the plane electrodes spread out over the entire cell). In other words, luminous efficiency does not improve as discussed in this publication. Moreover, rather than concluding that the discharges spread out while gradually weakening, it is more reasonable to conclude that the volume of plasma reduces compared to the prior art as the discharges occur in a slender contour along the narrowing area, resultantly reducing the intensity of the ultraviolet rays that irradiate the fluorescent material layer 55, and alleviating the luminescence saturation of the fluorescent material. In any case, the actions and effects concerning the plane electrode structure described in the Japanese Unexamined Patent Publication No. 11-149873 of 1999 do not deviate from or exceed those described in the Japanese Unexamined Patent Publication No. 8-22772 of 1996 and the Japanese Unexamined Patent Publication No. 8-250030 of 1996.

In the meantime, in order to suppress the discharge interferences between vertically and horizontally adjacent cells while maintaining a proper transition capability from the writing operation to the sustaining operation, it is necessary to accommodate an element that is equipped with regions that can easily generate discharges and regions that can easily store wall charges in the area between the data electrode 52 and the scan electrode 59 that generate writing discharges (opposing discharges) and in the area between the scan electrode 59 and the common electrode 60 that generates sustaining discharges (plane discharges), and does not easily cause diffusion of plasma into the vertically and horizontally adjacent cells. This is important from the point of achieving a high luminance and a high luminous efficiency because the power consumption increases when the discharge starting voltage increases.

To enlarge the discharge area by means of the so-called discharge area effect and volumetric effect as shown in the description of paragraph No. [0018] and FIG. 4 of the Japanese Unexamined Patent Publication No. 8-22772 of 1996 is an effective means of encouraging discharges. An alternative method is to form a discharge gap section that follows Paschen's rule (the rule that the minimum voltage required for causing a spark discharge under a constant temperature and an electric field is a function of the product of the gas pressure and the distance between the electrodes) and induces the main discharge using the spark discharge that occurs there as a trigger. Another alternative method is to cause a severe strain in the electric field to cause it to develop into the main discharge (electric field strain trigger).

However, the discharge source area, where charged particles can be easily accelerated and generated in large quantities, causes faster deterioration of the protective layer 62 than in other areas, so that having such an area in the plane electrode area results in shortening of the operating life of the panel as well as the deterioration of the protective layer 62 advances extremely each time the sustaining discharge occurs. Therefore, it is concluded here that the use of the discharge area effect and volumetric effect is more desirable from the standpoint of reliability.

In order to suppress the discharge interferences between the vertically and horizontally adjacent cells using only the features of the plane electrode structure, without using the partitioning walls 54 and the like, it is necessary to make the initial discharges concentrate on the discharge gap area as much as possible, and prevent the main discharge from diffusing into the vertically and horizontally adjacent cells. As to this point, the conventional structure shown in FIG. 4 encourages the concentration of the initial discharge in the discharge gap 63 and makes the effect of the lines of electric force that extend from the surface of the dielectric layer 61 on the plane electrode 57*c* to reach the vertically and horizontally adjacent cells as the plane electrode 57*c* is narrowing toward the vertically and horizontally adjacent cells, thus making it easier to suppress the discharge interferences between the vertically and horizontally adjacent cells as a result.

However, the conventional structures shown in FIG. 4 does not allow plasma to spread on the entire cell, it presents a shortcoming in that the luminance is too low and luminous efficiency is not fully improved. If the area of the plane electrode 57*c* is expanded in order to compensate for the shortcoming, it brings another problem in that the discharge interferences occur more easily between adjacent cells as mentioned above. In other words, it was impossible to solve this tradeoff relationship with the conventional plane electrodes 57*b* and 57*c*.

However, it can be solved by providing a plane electrode structure having micro sustaining discharge sections divided into several regions as mentioned above. In other words, this is the first time a common solution has been achieved to satisfy both the light emission characteristics (luminance and luminous efficiency) and voltage characteristics (transition from the writing operation to the sustaining operation and discharging interferences between adjacent cells).

As can be seen from the above analysis, there is a need for spatially establishing micro constituent elements in order to materialize the desired plane electrode structure. Therefore, it was decided to use photolithography (a process of patterning the electrode material using photo resist as a mask), which makes a high precision patterning possible. Moreover, as it was realized that it is effective to divide the cell space into a matrix and treat the arrays for each unit block analytically concerning certain basic structural elements in seeking a two dimensional plane electrode structure, it was also decided to construct the plane electrode structure using simplified basic elements in this embodiment of the invention.

Based on the above analysis, the embodiments of the invention will be described in the following referring to the accompanying drawings.

Embodiment 1

Figure 7:
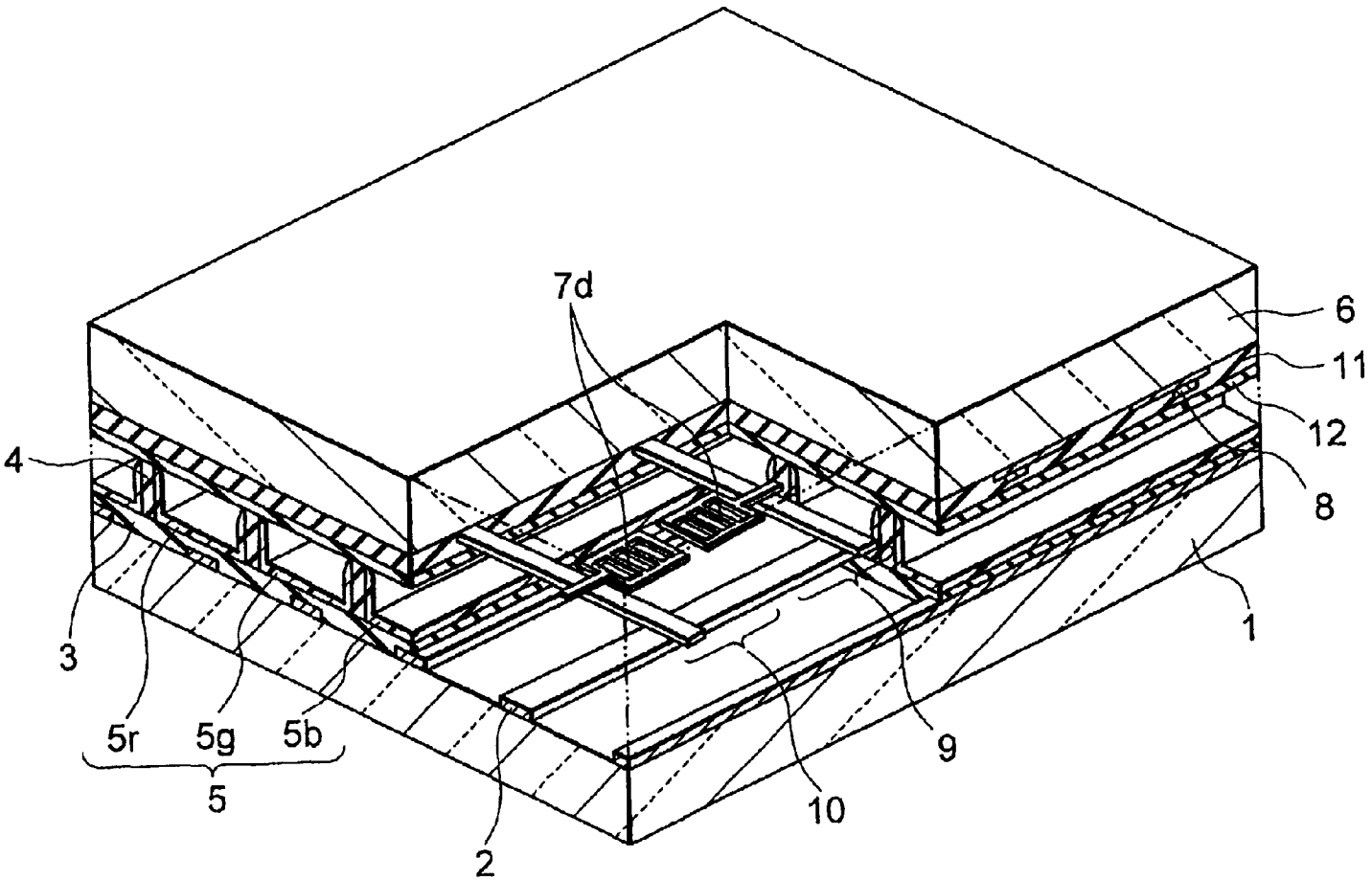
FIG. 7 is a partial cutout perspective view showing the constitution of a first embodiment of PDP of the invention.
Figure 8:
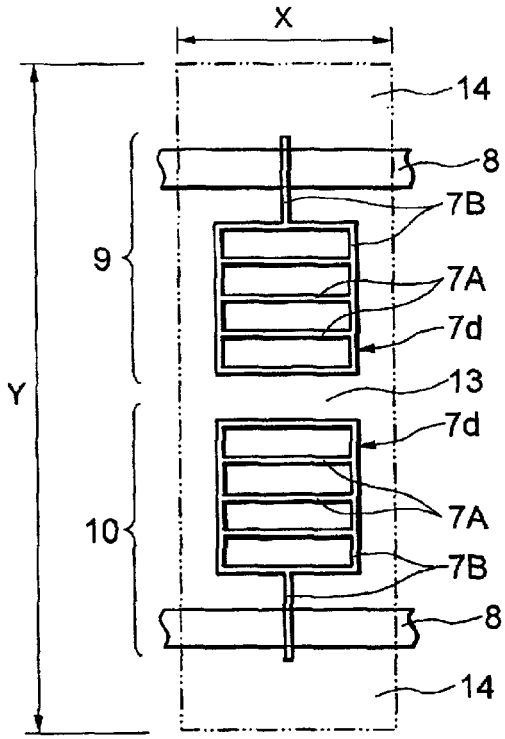
FIG. 8 is a plan view showing a unit cell portion of said PDP.

FIG. 7 is a partial cutout perspective view showing the constitution of a PDP according to a first embodiment of the present invention and FIG. 8 is a plan view showing a unit cell portion of said PDP.

In the PDP of the embodiment, a unit cell portion of the plane electrode consist of a plurality of thin wire electrodes 7A, which extend in the row direction and which are laid out at a constant interval from a discharge gap section 13 toward a non-discharge gap section 14 as shown in FIG. 8, where the left and right ends of these row direction thin wire electrodes 7A are connected with thin wire electrodes 7B that extend in the column direction to form horizontal slit-shaped plane electrodes 7*d*. The thin wire electrodes 7B that extend in the column direction from the center of the horizontal slit-shaped plane electrodes 7*d* and the bus electrodes 8 that extend in the row direction are connected to form a sustaining electrode pair (scan electrode 9 and common electrode 10).

Figure 1:
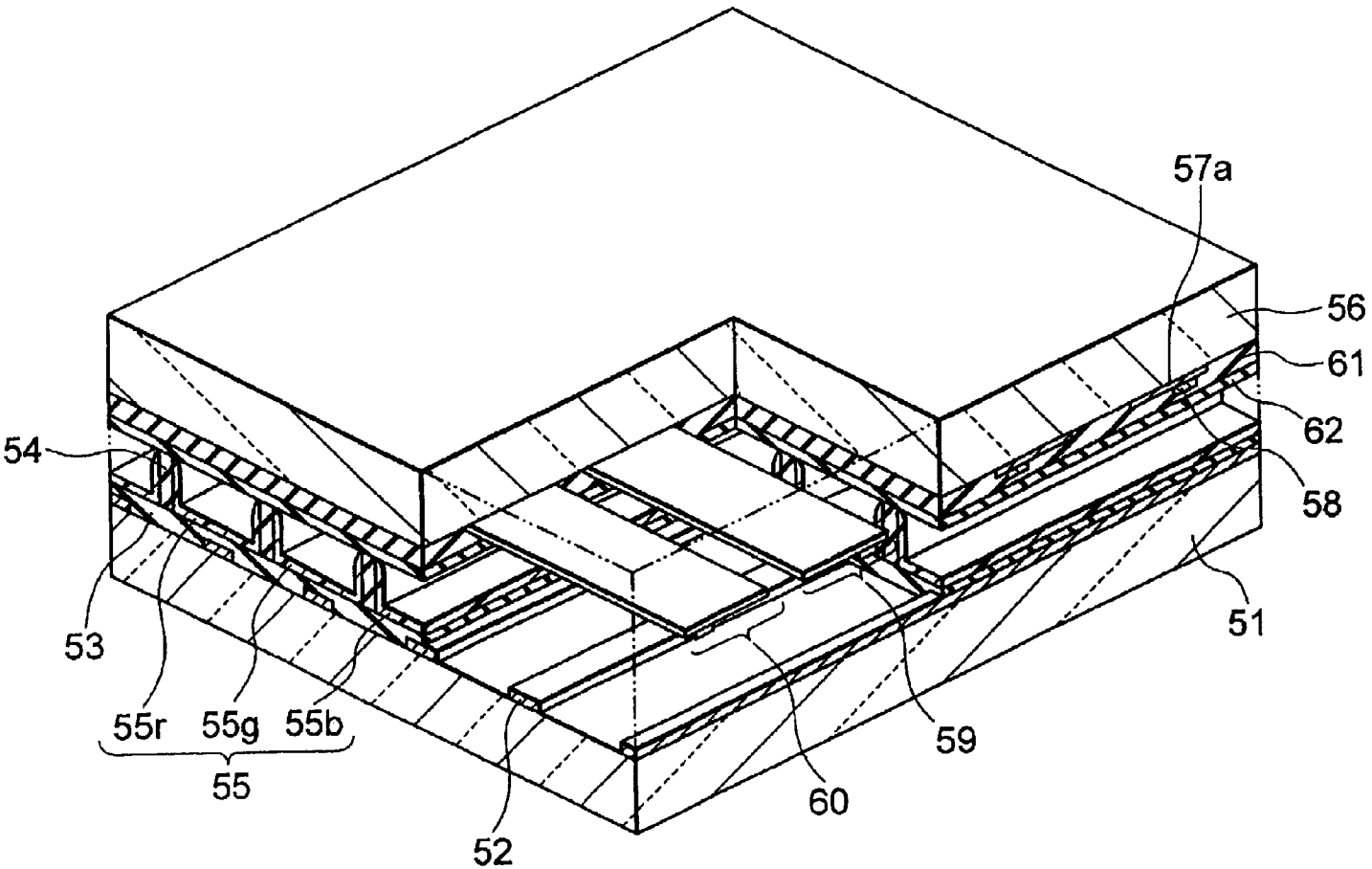
FIG. 1 (PRIOR ART)
FIG. 1 is a partial cutout perspective view showing the constitution of a conventional PDP.

The size of the cells that constitute the PDP of this example is typically 1050 $\mu$m (column direction dimension Y)×350 $\mu$m (row direction dimension X) and these cells are integrated to form the PDP shown in FIG. 7. The PDP shown in FIG. 7 has a structure approximately equal to the one shown in FIG. 1 except for the plane electrode. On a back substrate 1 made of soda lime glass, a plurality of data electrodes 2 made of Cr (chromium) with a thickness of approximately 200 nm and a width of approximately 100 $\mu$m are formed in the column direction through the cell's vertical center axis, on top of which is formed a white dielectric material layer 3 with a thickness of approximately 20 $\mu$m, which is made of PbO (lead oxide), $SiO_2$ (silicon oxide), $B_2O_3$ (boron oxide), $TiO_2$ (titanium oxide), $ZrO_2$ (zirconium oxide), etc. Formed on top of the white dielectric material layer 3 in the column direction between the horizontally adjacent cells are a plurality of substantially trapezoidal shaped partition walls 4 with a height of approximately 110 $\mu$m, a top width of approximately 50 $\mu$m and a bottom width of approximately 170 $\mu$m, which are made of PbO, $SiO_2$, $B_2O_3$, $TiO_2$, $ZrO_2$, $Al_2O_3$, etc., and on the side surfaces of which and on the white dielectric material layer 3 repetitively formed are fluorescent layers 5 consisting of fluorescent material layers 5*r*, 5*g* and 5*b*, which emit visible red (r), green (g) and blue (b) light respectively, and each of which has a thickness of 12–15 $\mu$m.

Beneath a front substrate 6 made of soda lime glass, the horizontal slit-shaped electrodes 7*d* with a thickness of approximately 100 nm and a width of approximately 20 $\mu$m, which are made of ITO (indium tin-added oxide), are formed in plurality to constitute a plurality of pairs, each pair consisting of two parts positioned across the cell horizontal center line and away from the partition walls 4. Beneath the front substrate 6 including a portion of the horizontal slit-shaped plane electrode 7*d*, bus electrodes 8 with a thickness of approximately 200 nm and a width of approximately 50 $\mu$m are formed in plurality in the row direction, being connected to the horizontal slit-shaped plane electrodes 7*d*. Beneath the horizontal slit-shaped plane electrodes 7*d*, transparent dielectric material layer 11 with a thickness of approximately 20 $\mu$m, which is made of PbO, $SiO_2$, $B_2O_3$, etc., is formed, further beneath which is formed a protective layer 12 with a thickness of approximately 1 $\mu$m, which is made of MgO (magnesium oxide).

Said back substrate 1 and front substrate 6 are put together sandwiching their structures inside, and are airtight sealed together with flit glass seal provided on the fringes of the substrates. A discharged gas consisting of He (helium: approx. 67.9%), —Ne (neon: approx. 29.1%), and —Xe (xenon: approx. 3%) for generating ultraviolet rays is sealed inside at a pressure of approximately 53.3 kPa (Pascal).

The length of a discharge gap 13 (distance between adjacent plane electrodes on the sustaining discharge generating side) and the length of a non-discharge gap section 14 (distance between adjacent plane electrodes on the sustaining discharge non-generating side) are approximately 90

μm and approximately 200 μm respectively, and the bus electrodes 8 are positioned approximately 300 μm away from the discharge gap 13. The lengths of the row direction thin wire electrodes 7A and the column direction thin wire electrodes 7B that constitute horizontal slit-shaped electrodes 7*d* are both approximately 260 μm and the interval between the row direction thin wire electrodes 7A is approximately 40 μm. The horizontal slit-shaped plane electrodes 7*d* are approximately 20 μm away from the partition walls 4.

In the structure of the horizontal slit-like plane electrodes 7*d* shown in FIG. 8, the row direction thin wire electrodes 7A, where the lines of electric force that expand plasma are generated, are laid out at a constant interval from a discharge gap section 13 toward a non-discharge gap section 14. Consequently, a sufficient area sustaining electrode makes it possible to distribute plasma over the entire cell, thus improving luminance and luminous efficiency. As a result, the power consumption can be reduced. Moreover, since the plane electrode 7*d* is not spreading over the vertically and horizontally adjacent cells, the incorrect light turn on and turn off phenomenon due to discharge interferences between adjacent cells can be suppressed.

Figure 9:
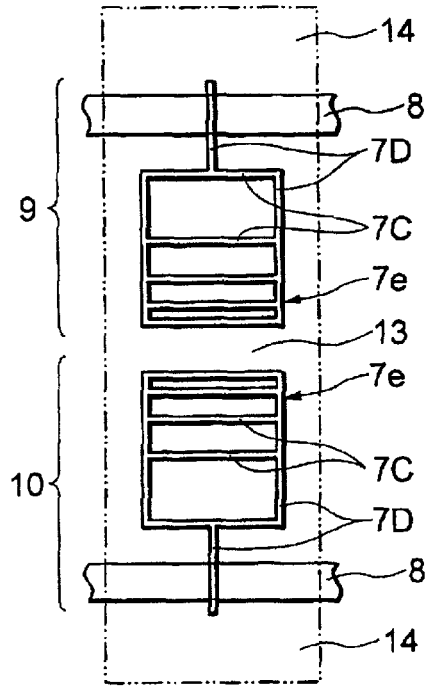
FIG. 9 is a plan view showing a unit cell portion of a first variation of the first embodiment PDP of the invention.

FIG. 9 is a plan view showing a unit cell portion of a first variation of the first embodiment PDP of the invention. In this first variation, a plurality of thin wire electrodes 7C that extend in the row direction are formed in such a way as to widen the interval at a fixed ratio (2 times) from the discharge gap section 13 toward the non-discharge gap section 14, and the left and right ends of these row direction thin wire electrodes 7C are connected by thin wire electrodes 7D that extend in the column direction to form horizontal slit-shaped plane electrodes 7*e*. The thin wire electrodes 7D that extend from the center of the horizontal slit-shaped plane electrode 7*e* in the column direction and the bus electrodes 8 that extend in the row direction are connected to form a sustaining electrode pair (scan electrode 9 and common electrode 10).

The cell structure in this first variation is approximately equal to the one shown in FIG. 8 except the plane electrode 7*e*. The lengths of the row direction thin wire electrodes 7C and the column direction thin wire electrodes 7D that constitute horizontal slit-shaped electrodes 7*e* are approximately 260 μm and 250 μm respectively, and the interval between the row direction thin wire electrodes 7C widens from the discharge gap section 13 side in steps of approximately 10, 20, 40 and 80 μm.

In the horizontal slit-shaped plane electrode 7*e* shown in FIG. 9, the row direction thin wire electrodes 7C are formed in such a way as to widen the interval at a fixed ratio from the discharge gap section 13 toward the non-discharge gap section 14. Consequently, a sufficient area sustaining electrode makes it possible to distribute plasma over the entire cell, thus improving luminance and luminous efficiency. Moreover, since the area of the plane electrode 7*e* of the discharge gap section 13 increases compared to the structure of the plane electrodes 7*d* shown in FIG. 8, the discharge area effect makes the writing discharge and the sustaining discharge occur more easily and improves the performance of transition from the writing operation to the sustaining operation. Moreover, since the density of the lines of electric force reduces from the discharge gap section 13 toward the non-discharge gap section 14, the discharge interferences can be further easily suppressed compared to the structure of the plane electrode 7*d* shown in FIG. 8.

Figure 10:
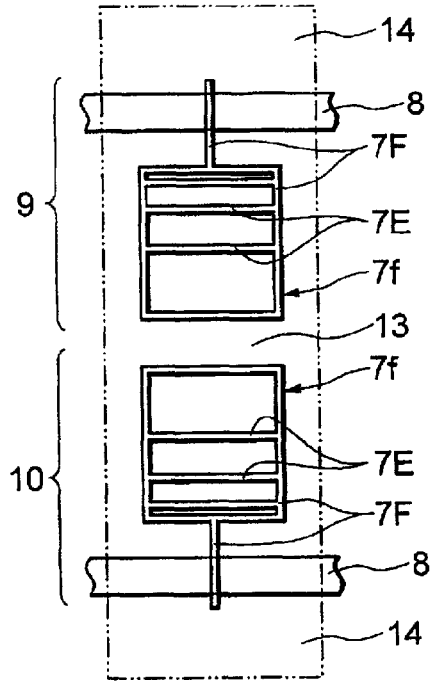
FIG. 10 is a plan view showing a unit cell portion of a second variation of the first embodiment PDP of the invention.

FIG. 10 is a plan view showing a unit cell portion of a second variation of the first embodiment PDP of the invention. In this second variation, a plurality of thin wire electrodes 7E that extend in the row direction are formed in such a way as to narrow the interval at a fixed ratio (1/2 time) from the discharge gap section 13 toward the non-discharge gap section 14, and the left and right ends of these row direction thin wire electrodes 7E are connected by thin wire electrodes 7F that extend in the column direction to form horizontal slit-shaped plane electrodes 7*f*. The thin wire electrodes 7F that extend from the center of the horizontal slit-shaped plane electrode 7*f* in the column direction and the bus electrodes 8 that extend in the row direction are connected to form a sustaining electrode pair (scan electrode 9 and common electrode 10).

The cell structure in this second variation is approximately equal to the one shown in FIG. 8 except for the plane electrode 7*f*. The lengths of the row direction thin wire electrodes 7E and the column direction thin wire electrodes 7F that constitute horizontal slit-shaped electrodes 7*f* are approximately 260 μm and 250 μm respectively, and the interval between the row direction thin wire electrodes 7E narrows from the discharge gap section 13 side in steps of approximately 80, 40, 20 and 10 μm.

In the horizontal slit-shaped plane electrode 7*f* shown in FIG. 10, the row direction thin wire electrodes 7E are formed in such a way as to narrow the interval at a fixed ratio from the discharge gap section 13 toward the non-discharge gap section 14. Consequently, a sufficient area sustaining electrode makes it possible to distribute plasma over the entire cell, thus improving luminance and luminous efficiency. Moreover, since the density of the lines of electric force increases from the discharge gap section 13 toward the non-discharge gap section 14, plasma can expand more easily over the entire cell by the sustaining discharge generated in the discharge gap section 13 and irradiate the fluorescent layer 5 more thoroughly compared to the structure of the plane electrode 7*d* shown in FIG. 8.

As can be seen from the above, in the structures of the plane electrodes 7*d* through 7*f* shown in the variations of the first embodiment including the first and second variations (FIG. 8 through FIG. 10), the left and right ends of the row direction thin wire electrodes 7A, 7C and 7E are connected by the column direction thin wire electrodes 7B, 7D and 7F respectively, but the row direction electrodes 7A, 7C and 7E can be connected only on one side, either the left or right side, or in the center. Moreover, the positions of the column direction thin wire electrodes 7B, 7D and 7F that are connected to the bus electrodes 8 do not have to be the center of the plane electrode, and the number of them is not restricted either.

Embodiment 2

Figure 11:
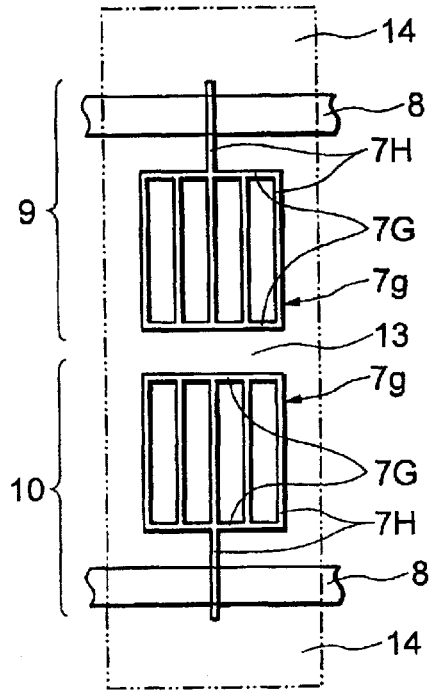
FIG. 11 is a plan view showing a unit cell portion of a second embodiment PDP of the invention.

FIG. 11 is a plan view showing a unit cell portion of a PDP according to a second embodiment of the invention. The major difference of the second embodiment PDP in comparison with the first embodiment described above is that the plane electrodes are made into a vertical slit-shape.

More specifically, as shown in FIG. 11, a plurality of thin electrodes 7H extending in the column direction are laid out at a constant interval from the cell's vertical center axis toward the partition walls 4 and the upper and lower ends of these column direction thin wire electrodes 7H are connected by thin wire electrodes 7G that extend toward the row direction to form vertical slit-shaped plane electrodes 7*g*. The thin wire electrodes 7H that extend from the center of the vertical slit-shaped plane electrode 7*g* in the column direction and the bus electrodes 8 that extend in the row direction are connected to form a sustaining electrode pair (scan electrode 9 and common electrode 10).

The cell structure in this first variation is approximately equal to the one shown in FIG. 8 except the plane electrode 7*g*. The lengths of the column direction thin wire electrodes 7H that constitute vertical slit-shaped electrodes 7*g* and the row direction thin wire electrodes 7G are both approximately 260 $\mu$m and the interval between the column direction thin wire electrodes 7H is approximately 40 $\mu$m.

In the structure of the vertical slit-like plane electrodes 7*g* shown in FIG. 11, the column direction thin wire electrodes 7H are laid out at a constant interval from the cell's vertical center axis toward the partition walls 4. Consequently, a sustaining electrode having a sufficient area makes it possible to generate sustaining discharge and distribute plasma over the entire cell, thus improving luminance and luminous efficiency. As a result, power consumption can be reduced. Moreover, since the plane electrode 7*g* does not spread over the vertically and horizontally adjacent cells, the incorrect light turn on and turn off phenomenon due to discharge interferences between adjacent cells can be suppressed.

Figure 12:
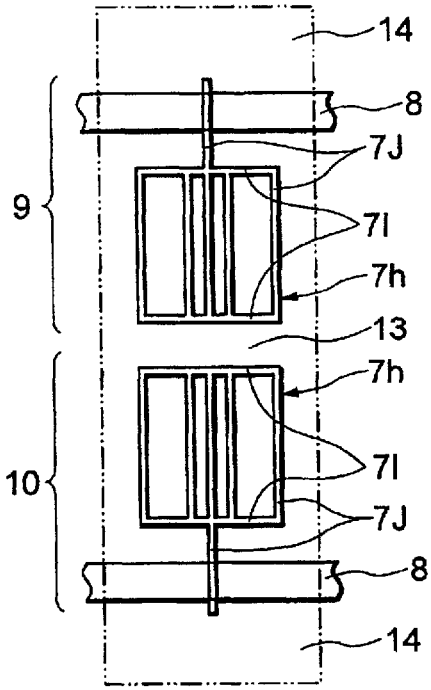
FIG. 12 is a plan view showing a unit cell portion of a first variation of the second embodiment of PDP of the invention.

FIG. 12 is a plan view showing a unit cell portion of a first variation of the PDP according to the second embodiment of the invention. In this first variation, a plurality of thin wire electrodes 7J that extend in the column direction are formed in such a way as to widen the interval at a fixed ratio (3 times) from the cell's vertical center axis toward the partition walls 4, and the upper and lower ends of these column direction thin wire electrodes 7J are connected by thin wire electrodes 7I that extend in the row direction to form vertical slit-shaped plane electrodes 7*h*. The thin wire electrodes 7J that extend from the center of the vertical slit-shaped plane electrode 7*h* in the column direction and the bus electrodes 8 that extend in the row direction are connected to form a sustaining electrode pair (scan electrode 9 and common electrode 10).

The cell structure in this first variation is approximately equal to the one shown in FIG. 8 except for the plane electrode 7*h*. The lengths of the column direction thin wire electrodes 7J that constitute vertical slit-shaped electrodes 7*h* and the row direction thin wire electrodes 7I are both approximately 260 $\mu$m, and the interval between the column direction thin wire electrodes 7J widens from the cell's vertical center axis in steps of approximately 20, and 60 $\mu$m.

In the vertical slit-shaped plane electrode 7*h* shown in FIG. 12, the column direction thin wire electrodes 7J are formed in such a way as to widen the interval at a fixed ratio from the cell's vertical center axis toward the partition walls 4. Consequently, a sustaining electrode having a sufficient area makes it possible to distribute plasma over the entire cell, thus improving luminance and luminous efficiency. Moreover, since the area of the plane electrode 7*h* of the discharge gap section 13 increases compared to the structure of the plane electrodes 7*g* shown in FIG. 11, the discharge area effect makes the writing discharge and the sustaining discharge easier and improves the performance of transition from the writing operation to the sustaining operation. Moreover, since the density of the lines of electric force reduces from the cell's vertical center axis toward the partition walls 4, the discharge interferences can be more easily suppressed compared to the structure of the plane electrode 7*g* shown in FIG. 11.

Figure 13:
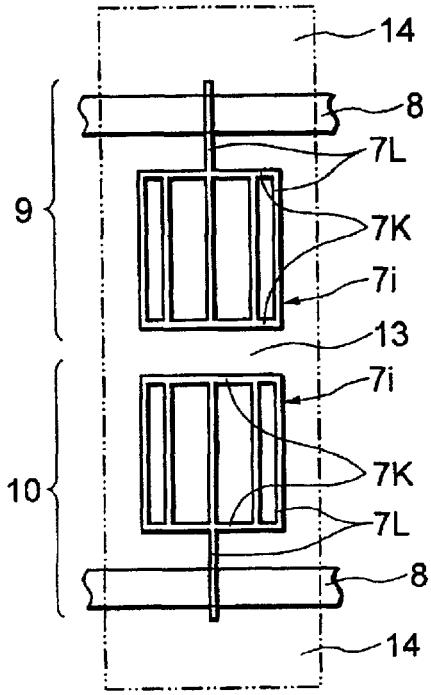
FIG. 13 is a plan view showing a unit cell portion of a second variation of the second embodiment of PDP of the invention.

FIG. 13 is a plan view showing a unit cell portion of a second variation of the second embodiment PDP of the invention. In this second variation, a plurality of thin wire electrodes 7L that extend in the column direction are formed in such a way as to narrow the interval at a fixed ratio (1/3 time) from the cell's vertical center axis toward the partition walls 4, and the upper and lower ends of these column direction thin wire electrodes 7L are connected by thin wire electrodes 7K that extend in the row direction to form vertical slit-shaped plane electrodes 7*i*. The thin wire electrodes 7L that extend from the center of the vertical slit-shaped plane electrode 7*i* in the column direction and the bus electrodes 8 that extend in the row direction are connected to form a sustaining electrode pair (scan electrode 9 and common electrode 10).

The cell structure in this second variation is approximately equal to the one shown in FIG. 8 except the plane electrode 7*i*. The lengths of the column direction thin wire electrodes 7L that constitute vertical slit-shaped electrodes 7*i* and the row direction thin wire electrodes 7K are both approximately 260 $\mu$m, and the interval between the column direction thin wire electrodes 7L narrows from the cell's vertical center axis in steps of approximately 60, and 20 $\mu$m.

In the vertical slit-shaped plane electrode 7*i* shown in FIG. 13, the column direction thin wire electrodes 7L are formed in such a way as to narrow the interval at a fixed ratio from the cell's vertical center axis toward the partition walls 4. Consequently, a sustaining electrode having a sufficient area makes it possible to distribute plasma over the entire cell, thus improving luminance and luminous efficiency. Moreover, since the density of the lines of electric force increases from the cell's vertical center axis toward the partition walls 4, plasma can expand more easily over the entire cell by the sustaining discharge generated in the discharge gap section 13 and irradiate the fluorescent layer 5 more thoroughly compared to the structure of the plane electrode 7*g* shown in FIG. 11.

As can be seen from the above, in the structures of the plane electrodes 7*g* through 7*i* shown in the variations of the second embodiment including the first and second variations (FIG. 11 through FIG. 13), the upper and lower ends of the column direction thin wire electrodes 7H, 7J and 7L are connected by the row direction thin wire electrodes 7G, 7I and 7K respectively, but the column direction electrodes 7H, 7J and 7L can be connected only on one side, either the upper or lower side, or in the center. Moreover, the positions of the column direction thin wire electrodes 7H, 7J and 7L that are connected to the bus electrodes 8 do not have to be the center of the plane electrode, and the number of them is not limited either.

Embodiment 3

Figure 14:
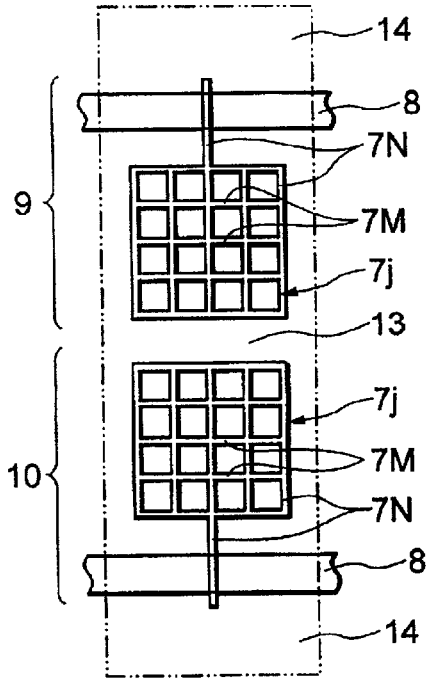
FIG. 14 is a plan view showing a unit cell portion of a third embodiment of PDP of the invention.

FIG. 14 is a plan view showing a unit cell portion of a third embodiment PDP of the invention. The major difference of the third embodiment PDP in comparison with the first embodiment described above is that the plane electrodes are made into a mesh-like shape.

More specifically, as shown in FIG. 14, a plurality of thin wire electrodes 7M extending in the row direction are laid out at a constant interval from a discharge gap section 13 toward a non-discharge gap section 14, and a plurality of thin electrodes 7N extending in the column direction are laid out at a constant interval from the cell's vertical center axis toward the partition walls 4. These row direction thin wire electrodes 7M and column direction thin wire electrodes 7N cross each other to form mesh-like plane electrodes 7*j*, and the thin wire electrodes 7N that extend from the center of the mesh-like plane electrodes 7*j* in the column direction and the bus electrodes 8 that extend in the row direction are connected to form a sustaining electrode pair (scan electrode 9 and common electrode 10).

The cell structure in this first variation is approximately equal to the one shown in FIG. 8 except for the plane electrode 7*j*. The lengths of the row direction thin wire electrodes 7M and the column direction thin wire electrodes 7N that constitute mesh-like plane electrodes 7*j* are both approximately 260 μm and the intervals between the row direction thin wire electrodes 7M as well as between the column direction thin wire electrodes 7N are both approximately 40 μm.

In the structure of the mesh-like plane electrodes 7*j* shown in FIG. 14, the row direction thin wire electrodes 7M are laid out at a constant interval from the discharge gap section 13 toward a non-discharge gap section 14, and the column direction thin electrodes 7N are laid out at a constant interval from the cell's vertical center axis toward the partition walls 4. Consequently, the sustaining electrode surface is larger than in the structure of the plane electrode 7*d* or 7*g* shown in FIG. 8 or FIG. 11, so that plasma generated by the sustaining discharge can expand more securely over the entire cell and improve the luminance and luminous efficiency. Also, since the area of the plane electrode 7*j* the discharge gap section 13 is larger than in the structure of the plane electrode 7*d* or 7*g* shown in FIG. 8 or FIG. 11, it makes the writing discharge and the sustaining discharge easier and improves the performance of transition from the writing operation to the sustaining operation. Moreover, since the plane electrode 7*j* does not spread over the vertically and horizontally adjacent cells, discharge interferences between adjacent cells can be suppressed.

Figure 15:
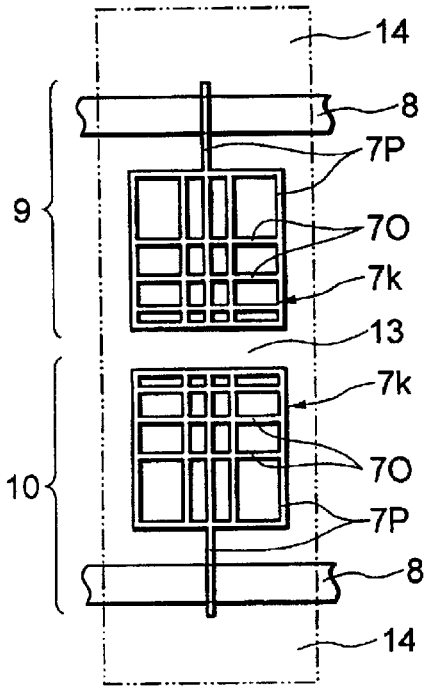
FIG. 15 is a plan view showing a unit cell portion of a first variation of the third embodiment of PDP of the invention.

FIG. 15 is a plan view showing a unit cell portion of a first variation of the third embodiment PDP of the invention. In this first variation, a plurality of thin wire electrodes 7O that extend in the row direction are formed in such a way as to widen the interval at a fixed ratio (2 times) from the discharge gap section 13 toward the non-discharge gap section 14, and a plurality of thin wire electrodes 7P that extend in the column direction are formed in such a way as to widen the interval at a fixed ratio (3 times) from the cell's vertical center axis toward the partition walls 4. These row direction thin wire electrodes 7O and column direction thin wire electrodes 7P cross each other to form mesh-like plane electrodes 7*k*, and the thin wire electrodes 7P that extend from the center of the mesh-like plane electrodes 7*k* in the column direction and the bus electrodes 8 that extend in the row direction are connected to form a sustaining electrode pair (scan electrode 9 and common electrode 10).

The cell structure in this first variation is approximately equal to the one shown in FIG. 8 except for the plane electrode 7*k*. The lengths of the row direction thin wire electrodes 7O and the column direction thin wire electrodes 7P that constitute mesh-like plane electrodes 7*k* are approximately 260 μm and 250 μm respectively. The intervals between the row direction thin wire electrodes 7O widen from the discharge gap section 13 side in steps of approximately 10, 20, 40 and 80 μm and the intervals between the column direction thin wire electrodes 7P widen from the cell's vertical center axis in steps of approximately 20 and 60 μm.

In the structure of the mesh-like plane electrodes 7*k* shown in FIG. 15, the row direction thin wire electrodes 7O are laid out in such a way as to widen the interval at a fixed ratio from the discharge gap section 13 toward the non-discharge gap section 14, and the column direction thin electrodes 7P are laid out in such a way as to widen the interval at a fixed ratio from the cell's vertical center axis toward the partition walls 4. Consequently, the sustaining electrode surface is larger than in the structure of the plane electrode 7*e* or 7*h* shown in FIG. 9 or FIG. 12, so that plasma generated by the sustaining discharge can expand more securely over the entire cell and improve luminance and luminous efficiency. Also, since the area of the plane electrode 7*k* of the discharge gap section 13 is larger than in the structure of the plane electrode 7*e* or 7*h* shown in FIG. 9 or FIG. 12, it makes the writing discharge and the sustaining discharge easier and improves the performance of transition from the writing operation to the sustaining operation. Moreover, since the density of the lines of electric force reduces from the discharge gap section 13 toward the non-discharge gap section 14 and the density of the lines of electric force reduces from the cell's vertical center axis toward the partition walls 4, the discharge interferences between adjacent vertically and horizontally cells can be further easily suppressed.

Figure 16:
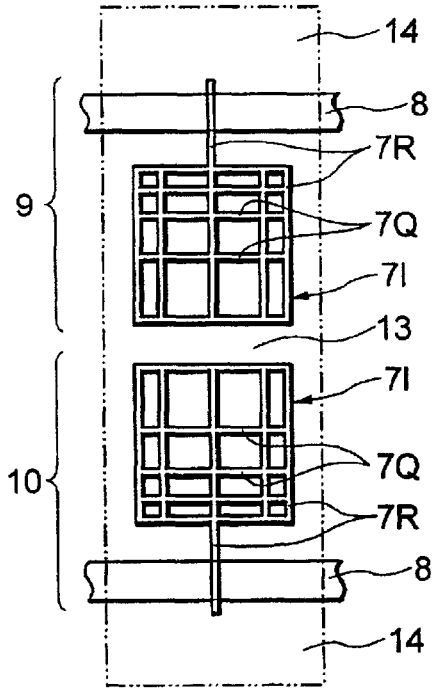
FIG. 16 is a plan view showing a unit cell portion of a second variation of the third embodiment of PDP of the invention.

FIG. 16 is a plan view showing a unit cell portion of a second variation of the PDP according to the third embodiment of the invention. In this second variation, a plurality of thin wire electrodes 7Q that extend in the row direction are formed in such a way as to narrow the interval at a fixed ratio (1/2 time) from the discharge gap section 13 toward the non-discharge gap section 14, and a plurality of thin wire electrodes 7R that extend in the column direction are formed in such a way as to narrow the interval at a fixed ratio (1/3 times) from the cell's vertical center axis toward the partition walls 4. These row direction thin wire electrodes 7Q and column direction thin wire electrodes 7R cross each other to form mesh-like plane electrodes 7*l*, and the thin wire electrodes 7R that extend from the center of the mesh-like plane electrodes 7*l* in the column direction and the bus electrodes 8 that extend in the row direction are connected to form a sustaining electrode pair (scan electrode 9 and common electrode 10).

The cell structure in this second variation is approximately equal to the one shown in FIG. 8 except the plane electrode 7*l*. The lengths of the row direction thin wire electrodes 7Q and the column direction thin wire electrodes 7R that constitute mesh-like plane electrodes 7*l* are approximately 260 μm and 250 μm respectively. The intervals between the row direction thin wire electrodes 7Q narrow from the discharge gap section 13 side in steps of approximately 80, 40, 20 and 10 μm and the intervals between the column direction thin wire electrodes 7R narrow from the cell's vertical center axis in steps of approximately 60 and 20 μm.

In the structure of the mesh-like plane electrodes 7*l* shown in FIG. 16, the row direction thin wire electrodes 7Q are laid out in such a way as to narrow the interval at a fixed ratio from the discharge gap section 13 toward the non-discharge gap section 14, and the column direction thin wire electrodes 7R are laid out in such a way as to narrow the interval at a fixed ratio from the cell's vertical center axis toward the partition walls 4. Consequently, the sustaining electrode surface is larger than in the structure of the plane electrode 7*f* or 7*j* shown in FIG. 10 or FIG. 13, so that plasma generated by the sustaining discharge can expand more securely over the entire cell and improve the luminance and luminous efficiency. Also, since the area of the plane electrode 7*l* of the discharge gap section 13 is larger than in the structure of the plane electrode 7*f* or 7*j* shown in FIG. 10 or FIG. 13, it makes the writing discharge and the sustaining discharge easier and improves the performance of transition from the writing operation to the sustaining operation. Moreover, since the density of the lines of electric force increases from the cell's vertical center axis toward the partition walls 4, plasma can expand more easily over the entire cell by the sustaining discharge generated in the discharge gap section 13 and irradiate the fluorescent layer 5 more thoroughly compared to the structure of the plane electrode 7*f* or 7*j* shown in FIG. 10 or FIG. 13.

As can be seen from the above, in the structures of the plane electrodes 7*j* through 7*l* shown in the variations of the third embodiment including the first and second variations (FIG. 14 through FIG. 16), the positions of the column direction thin wire electrodes 7N, 7P and 7R that are connected to the bus electrodes 8 do not have to be the center of the plane electrode, and the number of them is not limited either.

Table 1 shows the voltage characteristics and the luminescence characteristics of each PDP obtained from the first through third embodiments described above (FIG. 8 through FIG. 16). The incorrect light turn on voltage margin is a value |Vfmin−Vsmax| obtained by subtracting the maximum sustaining discharge-starting voltage Vsmax of the selected cell from the minimum plane discharge-starting voltage Vfmin of the unselected cell, and incorrect discharge is more unlikely to occur as this value increases. In other words, it enables us to set a larger operating margin.

TABLE 1

| | FIG. 8 | FIG. 9 | FIG. 10 | FIG. 11 | FIG. 12 | FIG. 13 | FIG. 14 | FIG. 15 | FIG. 16 |
|---|---|---|---|---|---|---|---|---|---|
| Writing voltage (V) | 263 | 260 | 264 | 257 | 254 | 258 | 256 | 252 | 256 |
| Sustaining voltage (V) | 176 | 173 | 177 | 178 | 177 | 179 | 175 | 170 | 176 |
| Incorrect light turn on voltage margin (V) | 13 | 15 | 12 | 13 | 15 | 12 | 10 | 13 | 10 |
| luminance (cd/m$^2$) | 327 | 329 | 326 | 326 | 329 | 326 | 337 | 340 | 336 |
| Luminous efficiency (lm/W) | 1.33 | 1.37 | 1.32 | 1.31 | 1.35 | 1.30 | 1.26 | 1.30 | 1.25 |

As can be seen from Table 1, the PDPs shown in FIG. 9 (the first variation of the first embodiment) and FIG. 12 (the first variation of the second embodiment) have superior characteristics. From these results, we learned that it is preferable to secure a certain amount of electrode area in the region that constitutes the discharge gap section 13 (between the scan electrode 9 and the common electrode 10 as well as between the data electrode 2 and the scan electrode 9) in order to improve the performance of transition from the writing operation to the sustaining operation; and it is preferable to reduce the density of the lines of electrical force from the discharge gap section 13 toward the vertically and horizontally adjacent cells among other things. In particular, the finding that providing a sustaining discharge section in a plurality of steps in the direction perpendicular to the discharge gap section 13 is desirable for improving luminous efficiency and reliability as the peak value of momentary current during the initial period of a discharge can be reduced is also confirmed in the Japanese Unexamined Patent Publication No. 8-315735 of 1996. Consequently, an attempt was made to improve the plane electrode structure based on the plane electrode structures exemplified in FIG. 9 and FIG. 12.

Embodiment 4

Figure 17:
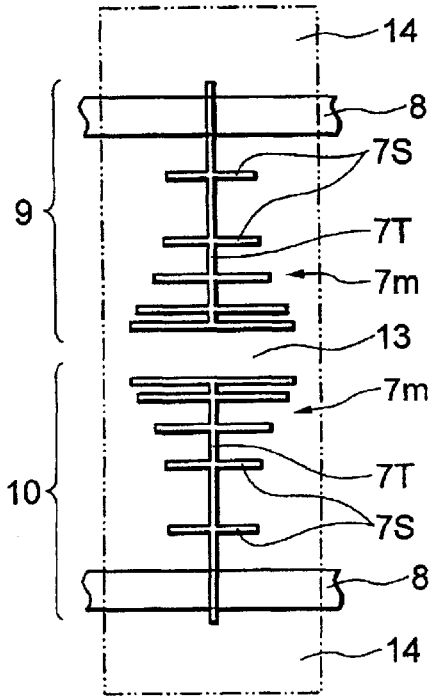
FIG. 17 is a plan view showing a unit cell portion of a fourth embodiment of PDP of the invention.

FIG. 17 is a plan view showing a unit cell portion of a PDP according to a fourth embodiment of the invention. The major difference of the fourth embodiment PDP in comparison with the first embodiment described above is that the plane electrodes are made into an antenna-shape.

In this case, as shown in FIG. 17, a plurality of thin wire electrodes 7S that extend in the row direction are laid out in such a way as to widen the interval at a fixed ratio (2 times) from the discharge gap section 13 toward the non-discharge gap section 14 as well as to shorten the lengths of those row direction thin wire electrodes 7S in steps with a fixed difference (approximately 20 μm×left/right) from the cell's vertical center axis toward the partition walls 4. They are connected by thin wire electrodes 7T that extend in the column direction to form antenna-shaped plane electrodes 7*m* and the thin wire electrodes 7T that extend in the column direction from the center of the antenna-shaped plane electrodes 7*m* and the bus electrodes 8 that extend in the row direction are connected to form a sustaining electrode pair (scan electrode 9 and common electrode 10).

The cell structure in this example is approximately equal to the one shown in FIG. 8 except for the plane electrode 7*m*. The lengths of the column direction thin wire electrodes 7T that constitute antenna-like plane electrodes 7*m* are approximately 250 μm. The intervals between the row direction thin wire electrodes 7S widen from the discharge gap section 13 side in steps of approximately 10, 20, 40 and 80 μm and their lengths shorten from the discharge gap section 13 side in steps of approximately 260, 220, 180, 140, and 100 μm.

In the structure of the antenna-like plane electrodes 7*m* shown in FIG. 17, the row direction thin wire electrodes 7S are laid out in such a way as to widen the interval at a fixed ratio from the discharge gap section 13 toward the non-discharge gap section 14, and the lengths of the row direction thin wire electrodes 7S shorten from the cell's vertical center axis toward the partition walls 4. Consequently, an luminance close to that of the structure of the plane electrode 7*k* shown in FIG. 15 can be achieved with a sustaining electrode surface smaller than those of the plane electrodes 7*e* and 7*h* shown in FIG. 9 and FIG. 12, so that an luminous efficiency higher than those of the plane electrodes 7*e* and 7*h* shown in FIG. 9 and FIG. 12 can be achieved. Moreover, since it is capable of deterring discharge interferences between adjacent cells more effectively than the structures of the plane electrodes 7*e* and 7*h* shown in FIG. 9 and FIG. 12, while maintaining a capability for transition from the writing operation to the sustaining operation equivalent to that of the structure of the plane electrodes 7*k* shown in FIG. 15, it provides a wider operating margin than any of the plane electrodes 7*e*, 7*h* and 7*k* structures shown in FIG. 9, FIG. 12 and FIG. 15.

Although the row direction thin wire electrodes 7S are longer on the discharge gap section 13 side and gradually shorten toward the non-discharge gap section 14 side in the structure of the plane electrodes 7*m* of the PDP described above, an opposite arrangement is also possible (where the row direction thin wire electrodes 7S are shorter on the discharge gap section 13 side and gradually elongate toward the non-discharge gap section 14 side). While the discharge starting voltage increases in such a case, transient discharge does not spread over the entire cell, so that it is still possible to improve luminance and luminous efficiency.

Embodiment 5

Figure 18:
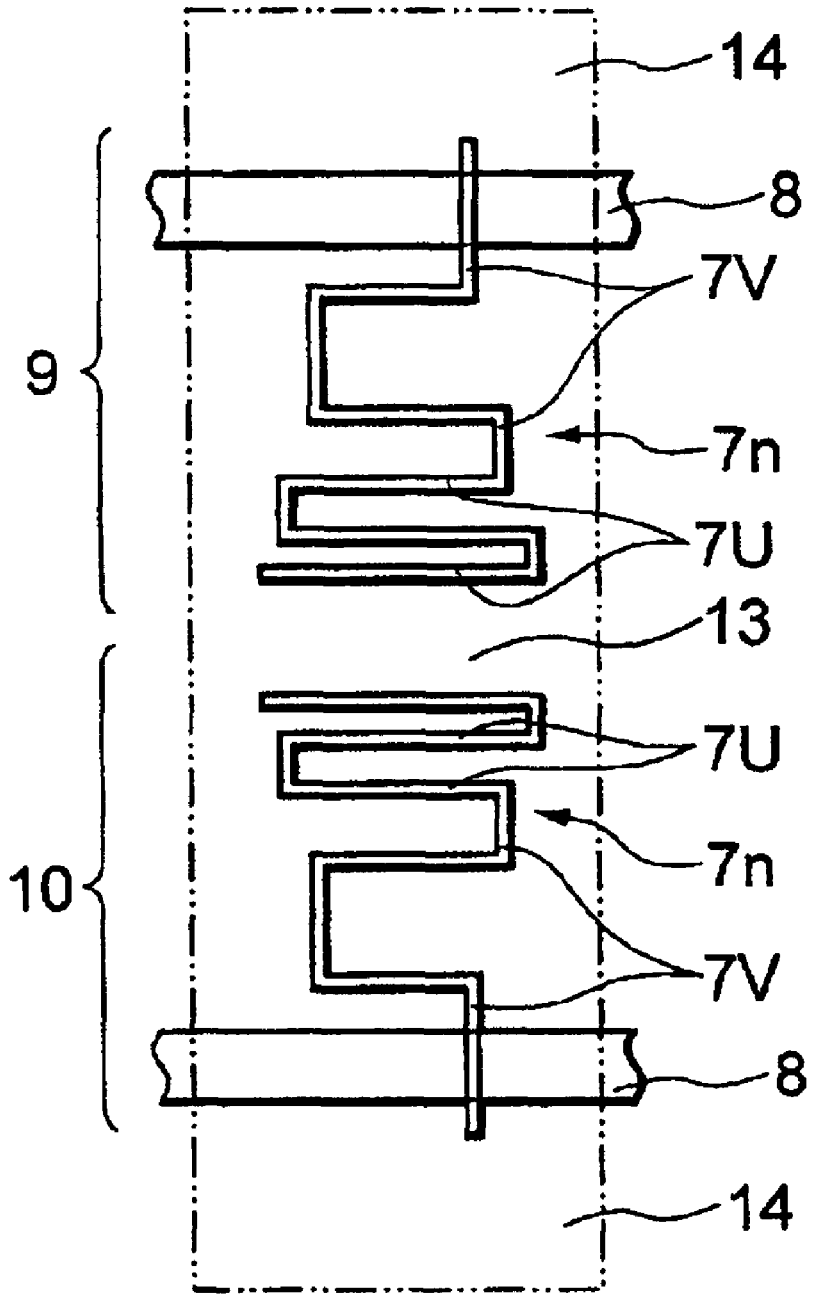
FIG. 18 is a plan view showing a unit cell portion of a fifth embodiment of PDP of the invention.

FIG. 18 is a plan view showing a unit cell portion of a fifth embodiment PDP of the invention. The major difference of this fifth embodiment PDP in comparison with the first embodiment described above is that the plane electrodes are made into a snake-shape.

In this case, as shown in FIG. 18, a plurality of thin wire electrodes 7U that extend in the row direction are laid out in such a way as to widen the interval at a fixed ratio (2 times) from the discharge gap section 13 toward the non-discharge gap section 14 as well as to shorten the lengths of those row direction thin wire electrodes 7U in steps with a fixed difference (approximately 20 $\mu$m×left/right) from the cell's vertical center axis toward the partition walls 4. The left and right ends of these row direction thin wire electrodes 7U are connected with thin wire electrodes 7V that extend in the column direction to form snake-shaped plane electrodes **7*n*, and the thin wire electrodes 7V that extend in the column direction from the snake-shaped plane electrodes 7*n* and the bus electrodes 8 that extend in the row direction are connected to form a sustaining electrode pair (scan electrode 9 and common electrode 10**).

The cell structure in this example is approximately equal to the one shown in FIG. 8 except for the plane electrode **7*n*. The intervals of the row direction thin wire electrodes 7U that constitute snake-shaped plane electrodes 7*n* widen from the discharge gap section 13 side in steps of approximately 10, 20, 40 and 80 $\mu$m and their lengths shorten from the discharge gap section 13 side in steps of approximately 260, 220, 180, 140, and 100 $\mu$m. The lengths of the column direction thin wire electrodes 7V elongate from the discharge gap section 13** side in steps of 50, 60, 80 and 120 $\mu$m.

The structure of the snake-shaped plane electrodes **7*n* shown in FIG. 18 has characteristics equivalent to that of the structure of the plane electrodes 7*m* shown in FIG. 17, and yet is capable of reducing the peak value of the momentary current compared to the structure of the plane electrodes 7*m* shown in FIG. 17. This is due to the fact that the structure of the plane electrodes 7*n* shown in FIG. 18 is constituted of an essentially single snaking thin electrode. Consequently, the momentary current that flows in the discharge gap section 13 in the initial period of a discharge tends to flow into the bus electrode 8 via a longer route than in the structure of the plane electrodes 7*m* shown in FIG. 17, so that the current that flows into the bus electrode 8 becomes less as a result of the voltage drop due to the resistances of the plane electrodes 7*n* themselves than in the case of the plane electrodes 7*m* shown in FIG. 17. Therefore, the peak value of the momentary current is lower and luminous efficiency is better in the case of the plane electrodes 7*n* shown in FIG. 18 than in the case of the plane electrodes 7*m* shown in FIG. 17**.

Although the row direction thin wire electrodes 7U are longer on the discharge gap section 13 side and gradually shorten toward the non-discharge gap section 14 side in the structure of the plane electrodes **7*n* of the PDP described above, an opposite arrangement is also possible (where the row direction thin wire electrodes 7U are shorter on the discharge gap section 13 side and gradually elongate toward the non-discharge gap section 14** side). While the discharge starting voltage increases in such a case, transient discharge does not spread over the entire cell, so that it is still possible to improve luminance and luminous efficiency.

Table 2 shows the voltage characteristics and the luminescence characteristics of each PDP obtained from the fourth and fifth embodiments described above (FIG. 17 and FIG. 18).

TABLE 2

| | FIG. 17 | FIG. 18 | FIG. 2 | FIG. 3 | FIG. 4 |
|---|---|---|---|---|---|
| Writing voltage (V) | 255 | 259 | 243 | 243 | 244 |
| Sustaining voltage (V) | 173 | 174 | 162 | 165 | 165 |
| Incorrect light turn on voltage margin (V) | 20 | 21 | 5 | 7 | 10 |
| luminance (cd/m$^2$) | 325 | 325 | 353 | 345 | 326 |
| Luminous efficiency (lm/W) | 1.41 | 1.42 | 0.95 | 1.03 | 1.12 |

As can be seen from Table 2, the PDPs according to the fourth and fifth embodiments have characteristics superior to the conventional PDPs shown in FIGS. 2 through 4.

The structures of the cells in these examples are approximately equal to the one shown in FIG. 8 except for the plane electrodes **7*m* and 7*n*. The plane electrodes 57*a* shown in FIG. 2 has a belt-like shape with a vertical width (column direction length of the plane electrode) of approximately 380 $\mu$m. The plane electrode 57*b* shown in FIG. 3 has a rectangular shape with a vertical width (column direction length of the plane electrode) of approximately 380 $\mu$m and a horizontal width (row direction length of the plane electrode) of approximately 260 $\mu$m. The plane electrode 57*c* shown in FIG. 4** has a T-shape consisting of a vertically longer rectangular shape with a vertical width (column direction length of the plane electrode) of approximately 300 $\mu$m and a horizontal width (row direction length of the plane electrode) of approximately 80 $\mu$m, and a horizontally longer rectangular shape with a vertical width (column direction length of the plane electrode) of approximately 80 $\mu$m and a horizontal width (row direction length of the plane electrode) of approximately 260 $\mu$m.

As can be seen from Table 2 and in comparison to the luminance between the conventional PDPs shown in FIG. 2 and FIG. 4, although the luminance reduces by approximately 8% by switching from the conventional structure shown in FIG. 2 to the conventional structure shown in FIG. 4, the luminous efficiency increases by approximately 18%. On the other hand, the comparison of the luminance and the luminous efficiency between the conventional PDP shown in FIG. 2 and the PDP according to the fifth embodiment of the invention shown in FIG. 18 reveals that, while the luminance reduces by approximately 8%, the luminous efficiency increases approximately by as much as 49% by changing the conventional structure shown in FIG. 2 to the structure of the fifth embodiment shown in FIG. 18. Since a higher luminous efficiency results in the saving of power consumption even if luminescence is increased by increasing the frequency of sustaining discharge, the PDPs according to the fourth and fifth embodiments of this invention shown in FIG. 17 and FIG. 18 can realize the luminance higher than any of the existing PDPs. As a result, the power consumption can be reduced further than in any existing PDPs. Furthermore, they can increase the operating margin to be wider than any of the existing PDPs, thus enabling us to achieve a display image quality which has never been obtainable.

In the PDPs according to this invention, the plane electrodes 7*d* through 7*n* are connected with the bus electrodes 8 via micro wiring, so that larger incorrect light turn on voltage margins can be used in contrast to the conventional structures. While the conventional structures have shortcomings in that they tend to caused discharge interferences if the bus electrode 8 is placed near the non-discharge gap section 14, the structures according to the present invention make it possible to increase the aperture of the cell as they are unlikely to cause any discharge interferences even if the bus electrode 8 is placed near the non-discharge gap section 14, i.e., near the adjacent cells. As a result, it is possible to improve luminance and luminous efficiency further. This effect cannot be found in any other types of existing PDPs.

It is also possible to control the dimensions of a plurality of micro discharge sections independently in the PDPs of this invention. Therefore, it is easier to control plasma-generating conditions and improve voltage characteristics and luminescence characteristics. This is another advantage that cannot be found in any other existing PDPs.

Embodiment 6

Figure 19:
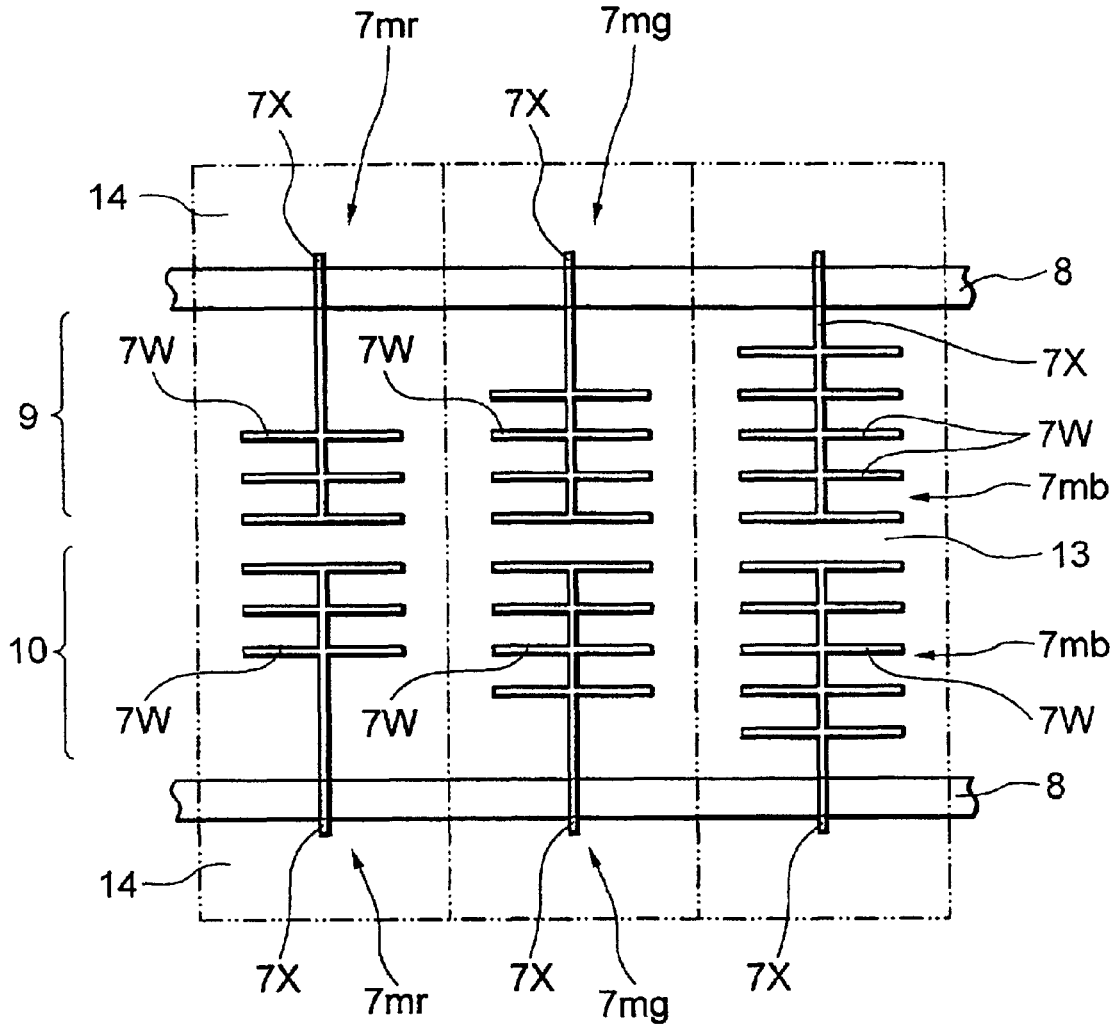
FIG. 19 is a plan view showing a unit pixel portion of a sixth embodiment of PDP of the invention.

FIG. 19 is a plan view showing a unit pixel portion (portion consisting of three cells, i.e., a red luminescence unit cell, a green luminescence unit cell and a blue luminescence unit cell) of a sixth embodiment PDP of the invention. The major difference in the structure of the sixth embodiment PDP from the abovementioned fourth embodiment is that the numbers of the row direction thin wire electrodes forming the antenna shape of the plane electrodes are different on each of the red cell, green cell and blue cell.

More specifically, as shown in FIG. 19, a plurality of equal length thin wire electrodes 7W that extend in the row direction are laid out at a fixed interval from the discharge gap section 13 toward the non-discharge gap section 14 and are connected by thin wire electrodes 7X that extend in the column direction to form each antenna shape in each of the antenna-shaped plane electrodes for red cells 7*mr*, the antenna-shaped plane electrodes for green cells 7*mg*, and the antenna-shaped plane electrodes for blue cells 7*mb*, and the number of the row direction thin wire electrodes 7W decrease in the order of the plane electrodes 7*mb*, plane electrodes 7*mg*, and plane electrodes 7*mr*. This feature is based on the following reasons.

Of the red visible light fluorescent material (r), green visible light fluorescent material (g), and blue visible light fluorescent material (b) that constitute the red cell, green cell, and blue cell respectively, the blue visible light fluorescent material (b) tends to deteriorate most during the manufacturing process, so that the deterioration of its luminance is severer than the other two fluorescent materials. This resulted in a drop of the color temperature of the manufactured conventional PDP in the past. Improvement of the color temperature that has hitherto been difficult can be easily achieved by adjusting the number of row direction thin wire electrodes 7W (micro discharge section) that constitute each of the plane electrodes 7*mr*, plane electrodes 7*mg*, and plane electrodes 7*mb*, in accordance with the luminance characteristics of each of the red cell, green cell and blue cell, as shown in FIG. 19.

Thus, it is possible to control each cell's luminance independently in order to realize PDPs with various luminance characteristics.

Although a method of controlling the color temperature by means of controlling the numbers of row direction thin wire electrodes that are laid out at a fixed interval is shown in this example, there is no need to lay out the row direction thin wire electrodes at a fixed interval, nor do their lengths have to be the same. For example, the areas of the row direction thin wire electrodes can be changed, or plane electrodes with different shapes and areas can be used for each cell. It is also possible to alleviate the variance of the writing voltage between the cells, by means of controlling the electrode area and shape of the sections that constitute the opposing and plane discharge gaps. As a result, the discharge variances within the panel surface can be reduced, and thus it becomes possible to improve the operating margin of the prior art.

Embodiment 7

Figure 20:
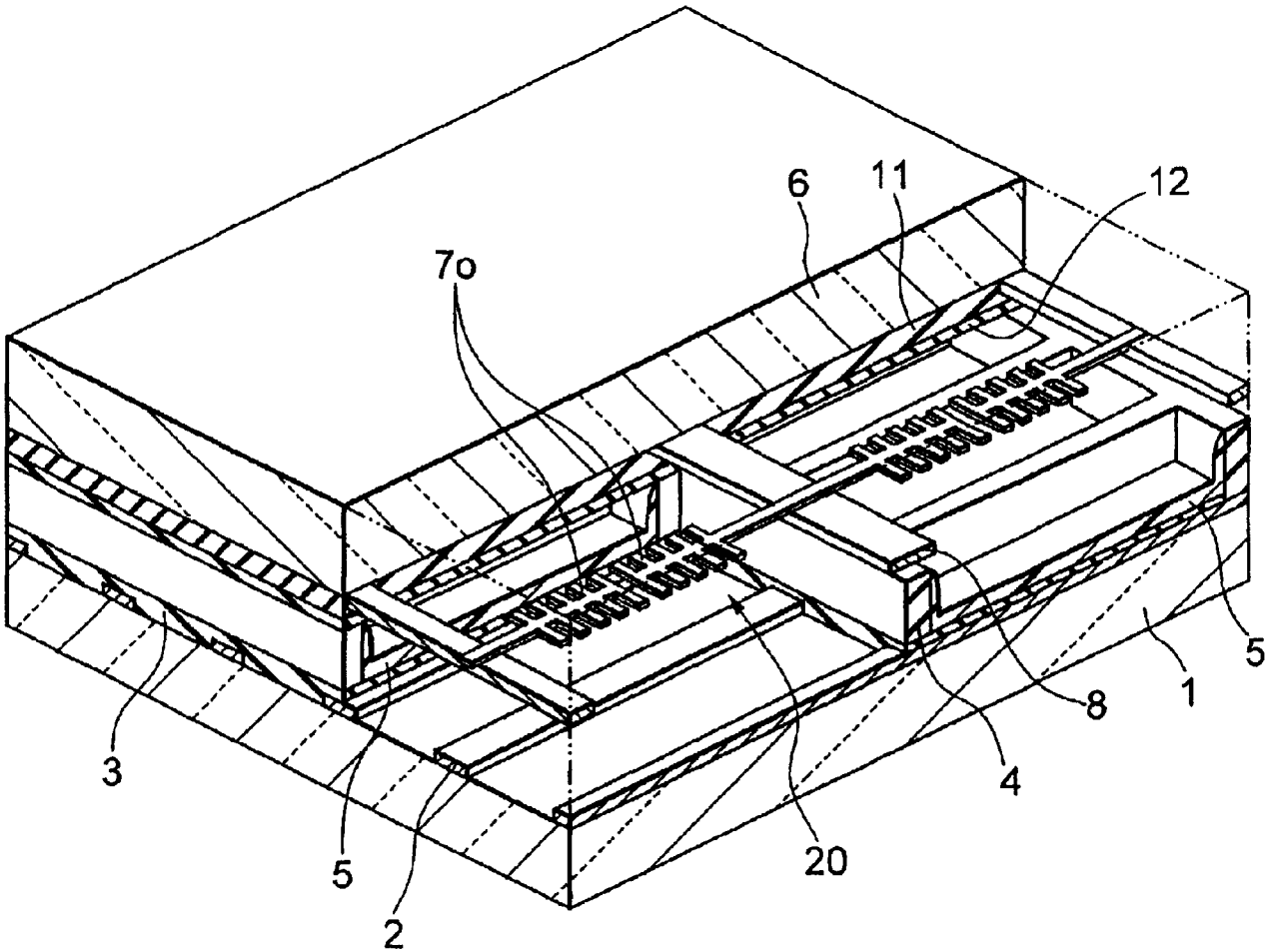
FIG. 20 is a partial cutout perspective view showing the constitution of a seventh embodiment of PDP of the invention.
Figure 21:
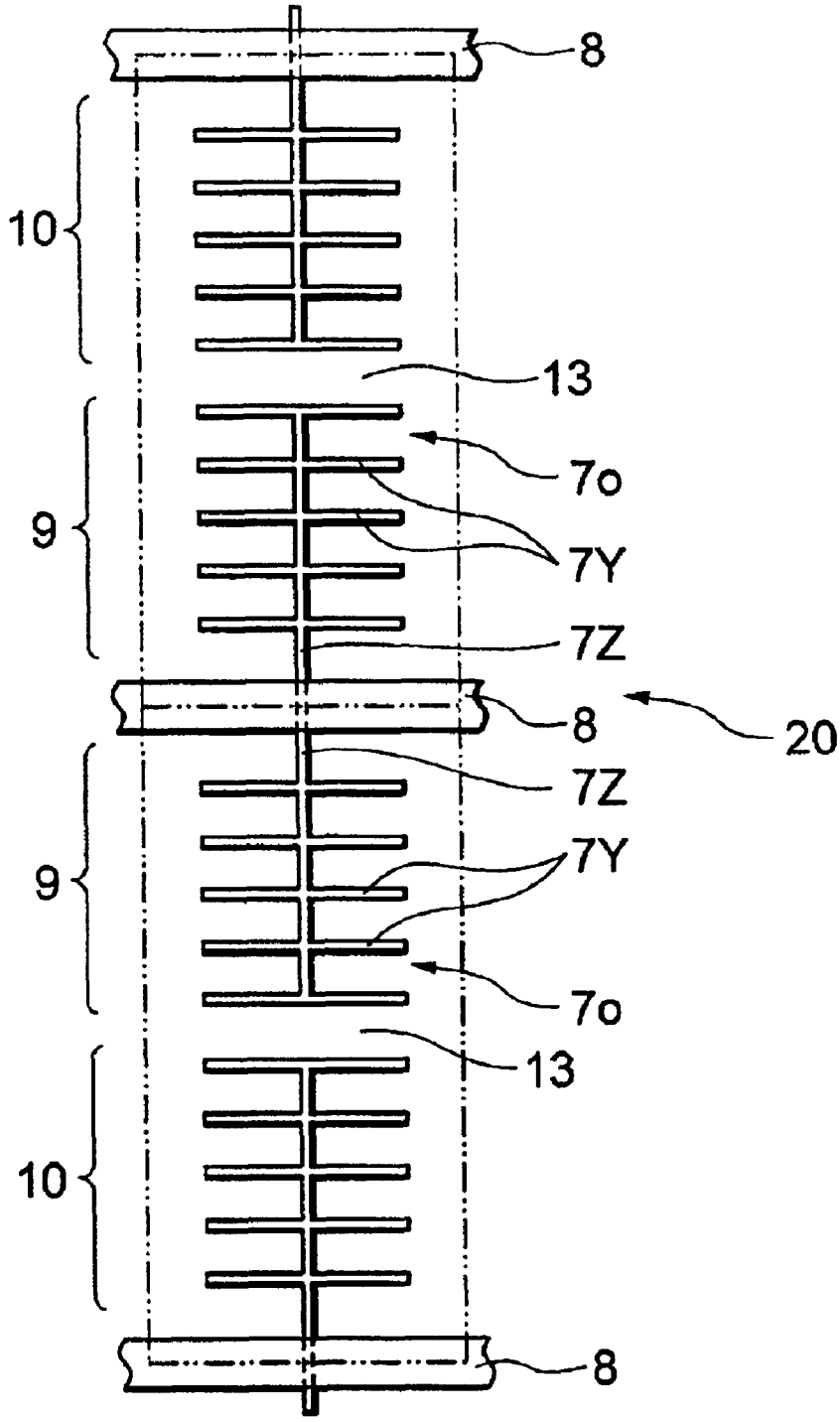
FIG. 21 is a plan view showing a unit cell portion of said PDP.

FIG. 20 is a partial cutout perspective view showing the constitution of a PDP according to a seventh embodiment of the invention and FIG. 21 is a plan view showing a unit cell portion of said PDP. The major difference in the structure of the seventh embodiment PDP from the abovementioned fourth embodiment is that the concept of the antenna-shaped plane electrode is applied to a double-sided electrode.

As shown in FIG. 20 and FIG. 21, a bus electrode 8 of double-sided electrodes 20 are positioned on a partition wall 4 located between the discharge cells adjacent in the vertical direction and double-sided antenna-shaped plane electrodes 7*o* extend into cells on both sides in the vertical direction. The double-sided antenna-shaped plane electrodes 7*o* are equipped with equal length thin wire electrodes 7Y extending in the row direction, which are laid out at a fixed interval from the discharge gap section 13 toward the bus electrode section 8 and are connected to the bus electrode 8 by thin wire electrodes 7Z that extend in the column direction.

As shown in FIG. 21, by constituting the double-sided electrode 20 with the double-sided antenna-shaped plane electrodes 7*o*, which are divided spatially, discharge of the cells adjacent in the vertical directions can be controlled independently, so that it becomes unnecessary to have a wide non-discharge gap, which is normally required in the conventional surface panels, thus making it possible to form the double-sided electrodes for a wider region within each cell. As a result, the advantage of the double-sided electrodes of this invention, which form divided discharge regions, can be more effectively utilized, substantially improving the luminous efficiency.

Although it is shown to constitute the double-sided electrodes 20 with the double-sided antenna-shaped plane electrodes 7*o* in this example, the double-sided electrodes 20 can be constituted not only with the double-sided antenna-shaped plane electrodes 7*o*, but with any type of plane electrode shown by each embodiment and their variations mentioned above. The plane electrode can be made of a transparent electrode or a metallic electrode such as in case of the bus electrode. For the special waveform signal required for driving the double-sided electrode 20 shown in this example, the waveform signal shown in the Japanese Unexamined Patent Publication No. 365619 of 1999 can be applied. Moreover, depending on the drive, it is also possible to use different shapes for the portions of the double-side antenna-shaped plane electrodes 7*o* that extend out to the upper and lower sides of the bus electrode 8.

As can be seen from various embodiments of the invention describe above, it is possible to achieve simultaneous improvement of luminance and luminous efficiency as well as substantial improvement of the operating margin that have not been hitherto possible. It is also possible with this invention to control luminance and voltage characteristics independently by each cell, so that it is easier to improve color temperature and to alleviate voltage variances more than ever. In other words, it is possible to obtain excellent PDPs that have never been possible before.

Although various variations of embodiments of this invention have been described in detail in the above, specific configurations are not limited to these embodiments, and any other design variations within the gist of the invention are included in the invention. For example, as long as it is within the plane electrode structure that has micro discharging sections spatially divided into several regions, it goes without saying that more meaningful characteristic improvements can be tried by optimizing the shapes of the micro discharging sections. Therefore, different from the embodiments, the discharge gap 13 can be formed with the bus electrodes 8, or the non-discharge gaps 14 can be formed with the plane electrodes 7*d* through 7*o*, or the plane electrodes 7*d* through 7*o* can be formed across a plurality of cells. The plane electrodes 7*d* through 7*l* exemplified in the first embodiment through the third embodiment (FIG. 7 through FIG. 16) can be substantially trapezoidal shapes or substantially triangular shapes as the plane electrodes 7*m* and 7*n* shown in the fourth embodiment (FIG. 17) and the fifth embodiment (FIG. 18), and there is no limitation to their configurations.

Moreover, if a plurality of plane electrode pairs with the same discharge gap are placed on different locations within a cell, statistical discharge probability improves and discharge miss can be reduced, so that it is possible to reduce the time required for the writing operation. As a result, it becomes possible to improve the operating margin further. Further more, if a plurality of plane electrode pairs with different discharge gaps are placed on different locations within a cell, discharge occurring locations will be dispersed in terms of space and time, so that further improvement in luminance and luminous efficiency can be expected.

Moreover, it is possible to constitute the plane electrodes 7*d* through 7*o* that constitute a PDP with only metallic materials. This is because, in the PDPs of this invention, the discharge sections that constitute the plane electrodes 7*d* through 7*o* are of microscopic sizes and high luminance and luminous efficiency are achievable, so that it is possible to sustain high quality display images even if the plane electrodes 7*d* through 7*o* are formed only with light-shielding metallic materials. By doing so, the plane electrodes 7*d* through 7*o* can be made of the same metallic material using the same process as the bus electrodes 8, thus eliminating the process of forming the plane electrode with transparent conductive materials, which have been indispensable, and reducing the number of fabrication processes. This will enable the reduction of the manufacturing cost.

There is no problem in fabricating the plane electrodes 7*d* through 7*o* made of metallic materials separate from the bus electrode. If the thickness of the metallic materials used for the plane electrodes 7*d* through 7*o* is chosen to be approximately less than 50 nm, visible light transmittance will increase to provide improved luminance and luminous efficiency. However, it is not preferable to reduce the thickness to less than 5 nm or so, as it will make secondary metallic film formation difficult and leave the metallic sections in island shapes, producing partially non-conductive regions. The same thing can be said about the case where the plane electrodes 7*d* through 7*o* are made of transparent conductive materials. Au (gold) or Au alloy, Ag (silver) or Ag alloy, Cu (copper) or Cu alloy, and Al or Al alloy are preferable as the metallic materials to be used for the plane electrodes 7*d* through 7*o* and the bus electrodes 8, i.e., the scan electrode 9 and the common electrode 10 as well as the data electrode 2. The reason for that is that these metals have low electric resistances. They contribute to minimization of voltage pulse waveform dulling and improvement of luminance fluctuations.

Cr (chromium) or Cr alloy, Ni (nickel) or Ni alloy, Ti (titanium) or Ti alloy, Ta (tantalum) or Ta alloy, and Hf (hafnium) or Hf alloy are also preferable metallic materials. The reason for that is that these materials have high melting points so that they are suitable for the PDP process, as well as that they have high corrosion resistances so that they contribute to the improvement of the reliability of the terminal connection areas. Mo (molybdenum) or Mo alloy, and W (tungsten) or W alloy are also preferable metallic materials. The reason for that is that they have low electric resistances and low visible light reflective factors. Low visible reflective factors contribute to the improvement of contrast under bright lights.

The electrode constitutions described above can be a single layer structure made of a single metallic material, or a multi-layer structure made of a plurality of metallic materials. A multi-layer structure can compensate the shortcomings of different layers. For example, it is possible to have a layer of Al, Cr, or Ni, which has a good contacting capability with insulation materials, beneath a layer of Au, Ag, or Cu, which has a poor contacting capability against insulation materials; or to have a layer of Cr, Ni, Ti, Ta, or Hf, which has a high corrosion resistance over a layer of Cu, Al, Mo, and W, which has a low corrosion resistance.

A portion of the technology described above can be applied to the conventional PDPs. For example, application of a slit-like or mesh-like design to the stripe plane electrode 57*a* shown in FIG. 1 and FIG. 2 can make a meaningful improvement to luminous efficiency. Thus, the technology of this invention is applicable to all PDPs that generate discharges using electrodes.

What is claimed is:

1. An AC plane discharge type plasma display panel comprising:

a front substrate provided with at least a pair of row electrodes that extend in the row direction; and a back substrate provided with at least a plurality of data electrodes that extend in the column direction, said substrates being arranged to face each other forming a discharge space therebetween into which a gas for generating ultraviolet light is introduced and sandwiching partition walls that separate unit illuminating pixels each of which has a fluorescent material layer that emits a visible light of a desired color, and said row electrodes consisting of bus electrodes that extend in said row direction and plane electrodes electrically connected to said bus electrodes, said plane electrodes consisting of discharge sections each discharge section being comprised of at least one thin, elongated portion extending in said column direction and at least two thin, elongated portions extending in said row direction, said portions extending in the row direction being spatially separated from each other and electrically connected to each other, wherein each of said plane electrodes is electrically connected to other plane electrodes that are connected to the same bus electrode via the bus electrode only.

2. A Plasma display panel according to claim 1 wherein said fluorescent material layers consist of a plurality of kinds that emit visible red, green and blue light.

3. A Plasma display panel according to claim 2 wherein plane electrodes of discharge cells having at least one kind of said plurality of fluorescent material layers have a different shape from plane electrodes of discharge cells that have other fluorescent material layers.

4. A Plasma display panel according to claim 1 wherein said plane electrodes are provided for each of said unit illuminating pixels independently.

5. A Plasma display panel according to claim 1 wherein a density of said divided discharge sections that constitute said plane electrode stays constant from the row direction center axis of said unit illuminating pixels toward outside.

6. A Plasma display panel according to claim 1 wherein a density of said divided discharge sections that constitute said plane electrode increases from the row direction center axis of said unit illuminating pixels toward outside.

7. A Plasma display panel according to claim 1 wherein a density of said divided discharge sections that constitute said plane electrode decreases from the row direction center axis of said unit illuminating pixels toward outside.

8. A Plasma display panel according to claim 1 wherein a density of said divided discharge sections that constitute said plane electrode stays constant from the column direction center axis of said unit illuminating pixels toward outside.

9. A Plasma display panel according to claim 1 wherein a density of said divided discharge sections that constitute said plane electrode increases from the column direction center axis of said unit illuminating pixels toward outside.

10. A Plasma display panel according to claim 1 wherein a density of said divided discharge sections that constitute said plane electrode decreases from the column direction center axis of said unit illuminating pixels toward outside.

11. A Plasma display panel according to claim 1 wherein a density of said divided discharge sections that constitute said plane electrode stays constant from the row direction center axis of said unit illuminating pixels toward outside and from the column direction center axis of said unit illuminating pixels toward outside.

12. A Plasma display panel according to claim 1 wherein a density of said divided discharge sections that constitute said plane electrode increases from the row direction center axis of said unit illuminating pixels toward outside and from the column direction center axis of said unit illuminating pixels toward outside.

13. A Plasma display panel according to claim 1 wherein a density of said divided discharge sections that constitute said plane electrode decreases from the row direction center axis of said unit illuminating pixels toward outside and from the column direction center axis of said unit illuminating pixels toward outside.

14. A Plasma display panel according to claim 1 wherein said bus electrodes that extend in said row direction are disposed between vertically adjacent discharge cells and said plane electrodes extend from said bus electrodes to the vertically adjacent discharge cells.

15. A Plasma display panel according to claim 1 wherein said bus electrodes are made of a metal or alloy and said plane electrodes are made of a transparent electric conductive material.

16. A Plasma display panel according to claim 1 wherein said bus electrodes are made of a metal or alloy and said plane electrodes are made of a metal or alloy which is the same material to or the different material from the bus electrode.

17. A Plasma display panel according to claim 16 wherein a thickness of said plane electrodes is between 5 nm and 50 nm.

18. A Plasma display panel according to claim 1 wherein each of said row electrode, and said data electrode has a single layer structure or a multi-layer structure at least partially consisting of one or more of the following substances: Au or Au alloy, Ag or Ag alloy, Cu or Cu alloy, Al or Al alloy, Cr or Cr alloy, Ni or Ni alloy, Ti or Ti alloy, Ta or Ta alloy, Hf or Hf alloy, Mo or Mo alloy, or W or W alloy.

19. An AC plane discharge type plasma display panel comprising:

a front substrate provided with a plurality of pairs of a scan electrode and a common electrode that extend in the row direction; and a back substrate provided with a plurality of data electrodes that extend in the column direction, said substrates being arranged to face to each other forming a discharge space therebetween into which a gas for generating ultraviolet light is introduced and sandwiching partition walls that separate unit illuminating pixels each of which has a fluorescent material layer that emits visible light of a desired color; and said scan electrodes and said common electrodes consisting of bus electrodes that extend in said row direction and plane electrodes electrically connected to said bus electrodes, said plane electrodes consisting of discharge sections comprised of at least one thin, elongated portion extending in said column direction and at least two thin, elongated portions extending in said row direction, said portions extending in the row direction being spatially separated from each other and electrically connected to each other, wherein each of said plane electrodes is electrically connected to other plane electrodes that are connected to the same bus electrode via the bus electrode only.

20. A Plasma display panel according to claim 19 wherein said fluorescent material layers consist of a plurality of kinds that emit visible red, green and blue light.

21. A Plasma display panel according to claim 20 wherein plane electrodes of discharge cells having at least one kind of said plurality of fluorescent material layers have a different shape from plane electrodes of discharge cells that have other fluorescent material layers.

22. A Plasma display panel according to claim 19 wherein said plane electrodes are provided for each of said unit illuminating pixels independently.

23. A Plasma display panel according to claim 19 wherein a density of said divided discharge sections that constitute said plane electrode stays constant from the row direction center axis of said unit illuminating pixels toward outside.

24. A Plasma display panel according to claim 19 wherein a density of said divided discharge sections that constitute said plane electrode increases from the row direction center axis of said unit illuminating pixels toward outside.

25. A Plasma display panel according to claim 19 wherein a density of said divided discharge sections that constitute said plane electrode decreases from the row direction center axis of said unit illuminating pixels toward outside.

26. A Plasma display panel according to claim 19 wherein a density of said divided discharge sections that constitute said plane electrode stays constant from the column direction center axis of said unit illuminating pixels toward outside.

27. A Plasma display panel according to claim 19 wherein the density of said divided discharge sections that constitute said plane electrode increases from a column direction center axis of said unit illuminating pixels toward outside.

28. A Plasma display panel according to claim 19 wherein a density of said divided discharge sections that constitute said plane electrode decreases from the column direction center axis of said unit illuminating pixels toward outside.

29. A Plasma display panel according to claim 19 wherein a density of said divided discharge sections that constitute said plane electrode stays constant from the row direction center axis of said unit illuminating pixels toward outside and from the column direction center axis of said unit illuminating pixels toward outside.

30. A Plasma display panel according to claim 19 wherein a density of said divided discharge sections that constitute said plane electrode increases from the row direction center axis of said unit illuminating pixels toward outside and from the column direction center axis of said unit illuminating pixels toward outside.

31. A Plasma display panel according to claim 19 wherein a density of said divided discharge sections that constitute said plane electrode decreases from the row direction center axis of said unit illuminating pixels toward outside and from the column direction center axis of said unit illuminating pixels toward outside.

32. A Plasma display panel according to claim 19 wherein said bus electrodes that extend in said row direction are disposed between vertically adjacent discharge cells and said plane electrodes extend from said bus electrodes to the vertically adjacent discharge cells.

33. A Plasma display panel according to claim 19 wherein said bus electrodes are made of a metal or alloy and said plane electrodes are made of a transparent electric conductive material.

34. A Plasma display panel according to claim 19 wherein said bus electrodes are made of a metal or alloy and said plane electrodes are made of a metal or alloy which is the same material to or the different material from the bus electrode.

35. A Plasma display panel according to claim 34 wherein a thickness of said plane electrodes is between 5 nm and 50 nm.

36. A Plasma display panel according to claim 19 wherein each of said scan electrode, said common electrode and said data electrode has a single layer structure or a multi-layer structure at least partially consisting of one or more of the following substances: Au or Au alloy, Ag or Ag alloy, Cu or Cu alloy, Al or Al alloy, Cr or Cr alloy, Ni or Ni alloy, Ti or Ti alloy, Ta or Ta alloy, Hf or Hf alloy, Mo or Mo alloy, or W or W alloy.

37. An AC plane discharge type plasma display panel comprising:

a front substrate provided with at least a pair of row electrodes that extend in the row direction; and a back substrate provided with at least a plurality of data electrodes that extend in the column direction, said substrates being arranged to face to each other forming a discharge space therebetween into which a gas for generating ultraviolet light is introduced and sandwiching partition walls that separate unit illuminating pixels each of which has a fluorescent material layer that emits a visible light of a desired color, and said row electrodes consisting of bus electrodes that extend in said row direction and plane electrodes electrically connected to said bus electrodes, said plane electrodes consisting of discharge sections that are divided spatially into a plurality of regions, wherein said plane electrodes consist of a plurality of thin wire electrodes extending in the row direction, which are disposed in such a way that their intervals expand at a specific rate from a discharge gap section to a non-discharge gap section, while the lengths of said thin electrodes shorten with a specific difference from said discharge gap section to said non-discharge gap section.

38. A Plasma display panel according to claim 37 wherein said plurality of thin wire electrodes extending in said row direction are connected to said bus electrodes via thin wire electrodes extending in the column direction.

39. An AC plane discharge type plasma display panel comprising:

a front substrate provided with a plurality of pairs of a scan electrode and a common electrode that extend in the row direction; and a back substrate provided with a plurality of data electrodes that extend in the column direction, said substrates being arranged to face to each other forming a discharge space therebetween into which a gas for generating ultraviolet light is introduced and sandwiching partition walls that separate unit illuminating pixels each of which has a fluorescent material layer that emits visible light of a desired color; and said scan electrodes and said common electrodes consisting of bus electrodes that extend in said row direction and plane electrodes electrically connected with said bus electrodes, said plane electrodes consisting of discharge sections that are divided spatially into a plurality of regions, wherein said plane electrodes consist of a plurality of thin wire electrodes extending in the row direction, which are disposed in such a way that their intervals expand at a specific rate from a discharge gap section to a non-discharge gap section, while the lengths of said thin electrodes shorten with a specific difference from said discharge gap section to said non-discharge gap section.

40. A Plasma display panel according to claim 39 wherein said plurality of thin wire electrodes extending in said row direction are connected to said bus electrodes via thin wire electrodes extending in the column direction.

* * * * *